US007340198B2

(12) United States Patent
Takigawa

(10) Patent No.: US 7,340,198 B2
(45) Date of Patent: Mar. 4, 2008

(54) PROCESS CARTRIDGE AND IMAGE FORMING APPARATUS FOR REDUCING THE EFFECT OF EXTERNAL FORCES

(75) Inventor: Junya Takigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 195 days.

(21) Appl. No.: 11/219,741

(22) Filed: Sep. 7, 2005

(65) Prior Publication Data

US 2006/0051131 A1 Mar. 9, 2006

(30) Foreign Application Priority Data

Sep. 7, 2004 (JP) ..... 2004-260325
Sep. 9, 2004 (JP) ..... 2004-263099
Sep. 15, 2004 (JP) ..... 2004-268548

(51) Int. Cl.
*G03G 21/18* (2006.01)

(52) U.S. Cl. ..... 399/113; 399/167

(58) Field of Classification Search ..... 399/113, 399/159, 167

See application file for complete search history.

(56) References Cited

U.S. PATENT DOCUMENTS 5,089,849 A 2/1992 Hiraoka
5,832,345 A 11/1998 Damji et al.
6,898,386 B2 5/2005 Takigawa
6,947,693 B2 * 9/2005 Kamiya et al. ..... 399/301
7,076,190 B2 * 7/2006 Jeon ..... 399/167
2001/0021320 A1 * 9/2001 Murayama et al. ..... 399/117
2004/0160646 A1 * 8/2004 Kudo et al. ..... 358/484
2005/0163526 A1 * 7/2005 Kawai et al. ..... 399/90
2007/0189805 A1 * 8/2007 Takigawa ..... 399/167

FOREIGN PATENT DOCUMENTS

EP 0 833 226 A2 4/1998
EP 0 833 227 A2 4/1998
GB 2 262 477 A 6/1993
JP 2-181165 7/1990
JP 2001-066970 3/2001
JP 3200208 6/2001
JP 2001-201999 7/2001
JP 3332582 7/2002
JP 3599263 9/2004

* cited by examiner

*Primary Examiner*—David M. Gray
*Assistant Examiner*—Ruth N. LaBombard
(74) *Attorney, Agent, or Firm*—Oblon, Spivak, McClelland, Maier & Neustadt, P.C.

(57) ABSTRACT

A process cartridge is detachably provided in an image forming apparatus having a main gear. The process cartridge includes a photoconductive unit and a rotatable unit, and a positioning member. The rotatable unit includes an unit body, an idler shaft, an idler gear attached to the idler shaft, a rotating gear coupled to the main gear via the idler gear, and a rotating member having a shaft and the rotating gear on the shaft of the rotating member. The positioning member positions the image carrying member and the rotating member with a predetermined distance therebetween, and includes an absorbing hole configured to reduce the effect of an external force, generated by a rotation of the main gear, applied from the main gear to the idler gear.

27 Claims, 16 Drawing Sheets

PROCESS CARTRIDGE AND IMAGE FORMING APPARATUS FOR REDUCING THE EFFECT OF EXTERNAL FORCES

BACKGROUND OF THE INVENTION

1. Technical Field

The present disclosure generally relates to a process cartridge and an image forming apparatus having a process cartridge.

2. Background

Using a process cartridge in an image forming apparatus is publicly known.

Such image forming apparatus may be an electro-photo copying machine, a printer, a facsimile, or a multi-functional machine capable of copying, printing, and facsimile.

The image forming apparatus includes a rotatable unit such as developing unit and cleaning unit, for example.

Such rotatable unit includes a rotating member such as developing roller and cleaning brush, for example. The rotating member has a shaft which is rotatably supported by the rotatable unit, and faces an image carrying member.

The above-mentioned process cartridge may have a configuration as explained below, for example.

A rotating gear is fixed on a shaft of the rotating member, and at least one idler gear is fixed on an idler shaft, which is rotatably supported by an unit body.

The rotating gear is meshed with the idler gear, and the idler gear is meshed with a main gear, which is rotatably supported by a frame of an image forming apparatus.

Therefore, rotation of the main gear can be transmitted to the rotating gear via the idler gear. Thereby, such configuration can drive the rotating member.

At this time, the pitch circle of the main gear and the pitch circle of the idler gear form a common tangent.

When the main gear rotates, in a line of action deviated from the common tangent with a pressure angle, the main gear applies an external force to the idler gear.

Therefore, the idler shaft is deformed periodically and vibrates. Such vibration of the idler shaft may be transmitted to the image carrying member. Thereby a banding action may happen on toner images formed on the image carrying member, and may result in image quality degradation.

Recently, an image forming apparatus using electro-photocopying process such as laser printer and digitally-controlled copying machine includes a process cartridge detachably provided to the image forming apparatus.

Such process cartridge includes a photoconductive member unit supporting a photoconductive member and at least one unit used for electro-photocopying process.

Such unit includes a developing unit, which develops an electrostatic latent image on the photoconductive member with toners, and a cleaning unit, which removes and recover toners remaining on the photoconductive member, for example.

Such developing unit and cleaning unit may be driven by a driving force transmitted from a driving source in the image forming apparatus.

Such developing unit and cleaning unit are referred as driven units because a driving force is transmitted from the driving source in the image forming apparatus. In this case, the photoconductive member unit is not referred as the driven unit.

A driving force is transmitted from the driving source in the image farming apparatus by coupling a driving gear of the image forming apparatus to a driven gear of each unit.

The process cartridge can be positioned in the image forming apparatus by placing a supported portion, provided to the photoconductive member unit, to a supporting portion, provided to the image forming apparatus.

In such configuration, the photoconductive member can be positioned in the image forming apparatus with higher precision, thereby the transfer of toner images from the photoconductive member to a transfer member can be favorably conducted.

However, in such positioning configuration, the driven unit such as developing unit and cleaning unit is attached to the image forming apparatus via the photoconductive member unit.

Therefore, if tolerances or manufacturing errors are accumulated up to a certain level, positional accuracy of such driven unit in the image forming apparatus may become deteriorated.

If the positional accuracy may deteriorate, a gear-to-gear distance between the driving gear and the driven gear may become larger or smaller from a predetermined distance, thereby engagement of the teeth of the gears may deteriorate.

If such drawback occurs, an unevenness in the a driving force transmission may results, thereby causing the driven gear to unevenly rotate, and vibration thereof may occur or the like, which leads to image quality degradation.

One background art device conducts positioning of a process cartridge and a driving system of an image forming apparatus using main reference and sub reference so that the image forming apparatus can correctly transmit a driving force to the process cartridge.

Another background art device uses technology which can maintain a distance between a photoconductive member and an developer carrying member by providing a slot hole for a supporting point of a driven unit in a direction perpendicular to a tangential direction of teeth engagement of a driving gear and a driven gear.

Still another background art uses a technology which can position a center of a photoconductive drum (i.e., photoconductive member) and a center of a developing sleeve with a predetermined positional relationship each other, and fix a photoconductive member case and developing member case with screws so that the photoconductive drum (i.e., photoconductive member) and the developing sleeve can be attached to an image forming apparatus with a higher precision.

However, such background devices may not cope with the above-mentioned drawbacks.

SUMMARY

The present disclosure relates to a process cartridge detachably provided in an image forming apparatus having a main gear. The process cartridge includes a photoconductive unit, a rotatable unit, and a positioning member. The rotatable unit includes an unit body, an idler shaft provided on the unit body, an idler gear attached to the idler shaft and configured to be rotatable around the idler shaft, a rotating gear coupled to the main gear via the idler gear, and a rotating member having a shaft and the rotating gear on the shaft of the rotating member. The rotating member rotates around the shaft of the rotating member and faces the image carrying member. The rotating member is driven by a driving force transmitted from the main gear via the idler gear and the rotating gear. The positioning member positions the image carrying member and the rotating member with a predetermined distance therebetween, and includes an absorbing hole configured to reduce the effects of an external force, generated by a rotation of the main gear, applied from the main gear to the idler gear.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF THE PREFERRED EMBODIMENTS

Figure 1:
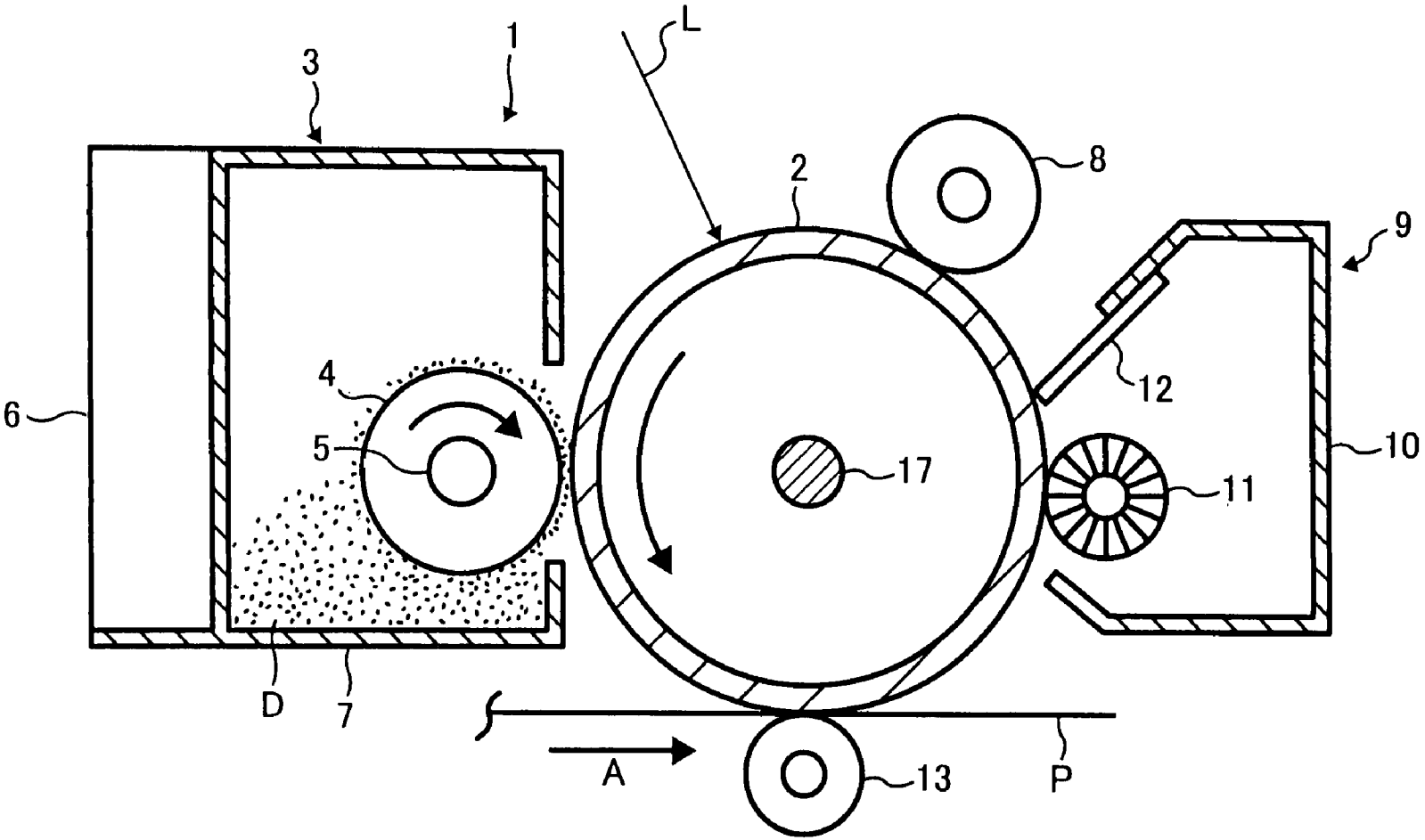
FIG. 1 is a schematic configuration of a process cartridge and other units in an image forming apparatus according to an example embodiment.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Figure 2:
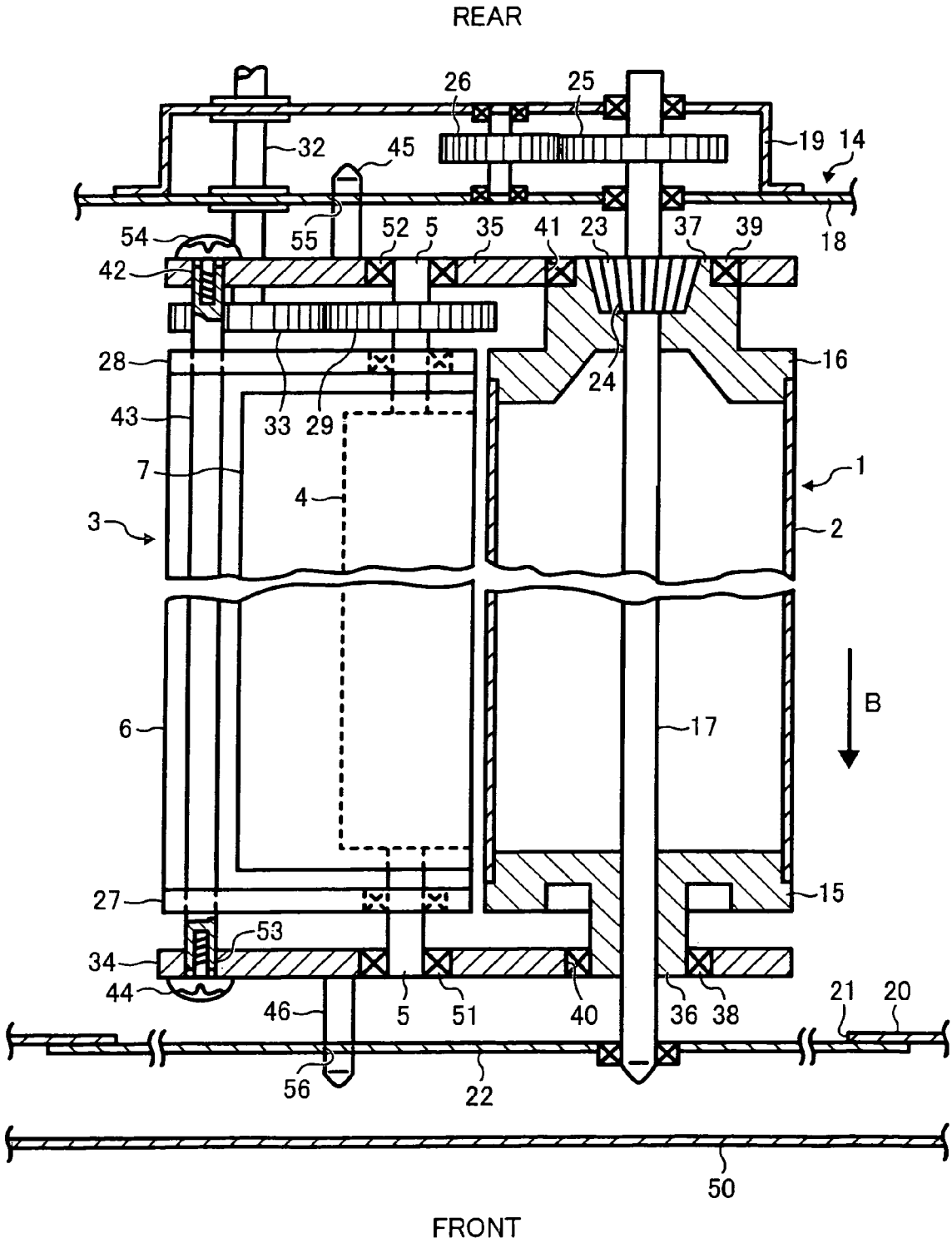
FIG. 2 is a schematic horizontal sectional view of a process cartridge of FIG. 1.

Referring now to the drawings, wherein like reference numerals designate identical or corresponding parts throughout the several views, and more particularly to FIGS. 1 to 2 thereof, an image forming apparatus according to one example embodiment is described.

FIG. 1 illustrates an image forming apparatus including a process cartridge 1 and other processing units, which are attached at predetermined positions in the image forming apparatus.

As shown in FIG. 1, the process cartridge 1 includes an image carrying member 2 and a developing unit 3 which includes a rotatable member.

The image carrying member 2 may include a photoconductive member having a drum shape.

The image carrying member 2 and the developing unit 3 are detachable with respect to the process cartridge 1 as described below, and are part of the process cartridge 1.

As shown in FIG. 1, the developing unit 3 includes a developing roller 4 having a shaft 5, and unit body 6. The developing roller 4 facing the image carrying member 2 is used a rotating member. The shaft 5 of the developing roller 4 is rotatably supported by the unit body 6. The shaft 5 may be integrally formed with the developing roller 4, or may be separately formed and then coupled to the developing roller 4, for example.

The unit body 6 includes a developing case 7 which may include a developer D such as dry-type developer. The developing roller 4 is in the developing case 7 as shown in FIG. 1.

Furthermore, the unit body 6 may be configured with only the developing case 7.

When an image forming operation is conducted, the image carrying member 2 rotates in a counterclockwise direction shown by an arrow in FIG. 1.

The image carrying member 2 is charged to a predetermined polarity with a charging roller 8. Then a writing beam L, emitted from a exposing device (not shown), irradiates a surface of the image carrying member 2 charged to the predetermined polarity to form an electrostatic latent image on the image carrying member 2.

On one hand, the developing roller 4 in the developing unit 3 rotates in a clockwise direction shown by a arrow in FIG. 1. At this time, the developing roller 4 carries the developer D on the surface thereof.

The developer D is then transferred on the surface of the image carrying member 2 to develop the electrostatic latent image as a toner image.

A sheet feed unit (not shown) feeds a transfer sheet P in a direction indicated by an arrow "A" as shown in FIG. 1. The toner image is transferred to the transfer sheet P under the effect of a transfer roller 13. Then the transfer sheet P is transported to a fixing unit (not shown), in which heat and pressure are applied to the transfer sheet P so that the toner image is fixed on the transfer sheet P.

Although not shown in FIG. 1, an image forming apparatus can take a configuration that a toner image formed on the image carrying member 2 is transferred to an intermediate transfer member (not shown) at first, and then transferred to a final transfer member (not shown).

After transferring the toner image to the transfer sheet P, toners remaining on the image carrying member 2 are removed by a cleaning unit 9. The cleaning unit 9 includes an unit body 10, a cleaning brush 11, and a cleaning blade 12.

The unit body 10 supports the cleaning brush 11 rotatably, and also supports the cleaning blade 12.

With the collaborative effect of the cleaning brush 11 and the cleaning blade 12, toners remaining on the image carrying member 2 are removed.

In an example embodiment, the unit body 10 of the cleaning unit 9 is used as cleaning case.

FIG. 2 is a schematic horizontal sectional view of the process cartridge 1 of FIG. 1, in which some components such as charging roller 8 and cleaning unit 9 are omitted.

Figure 3:
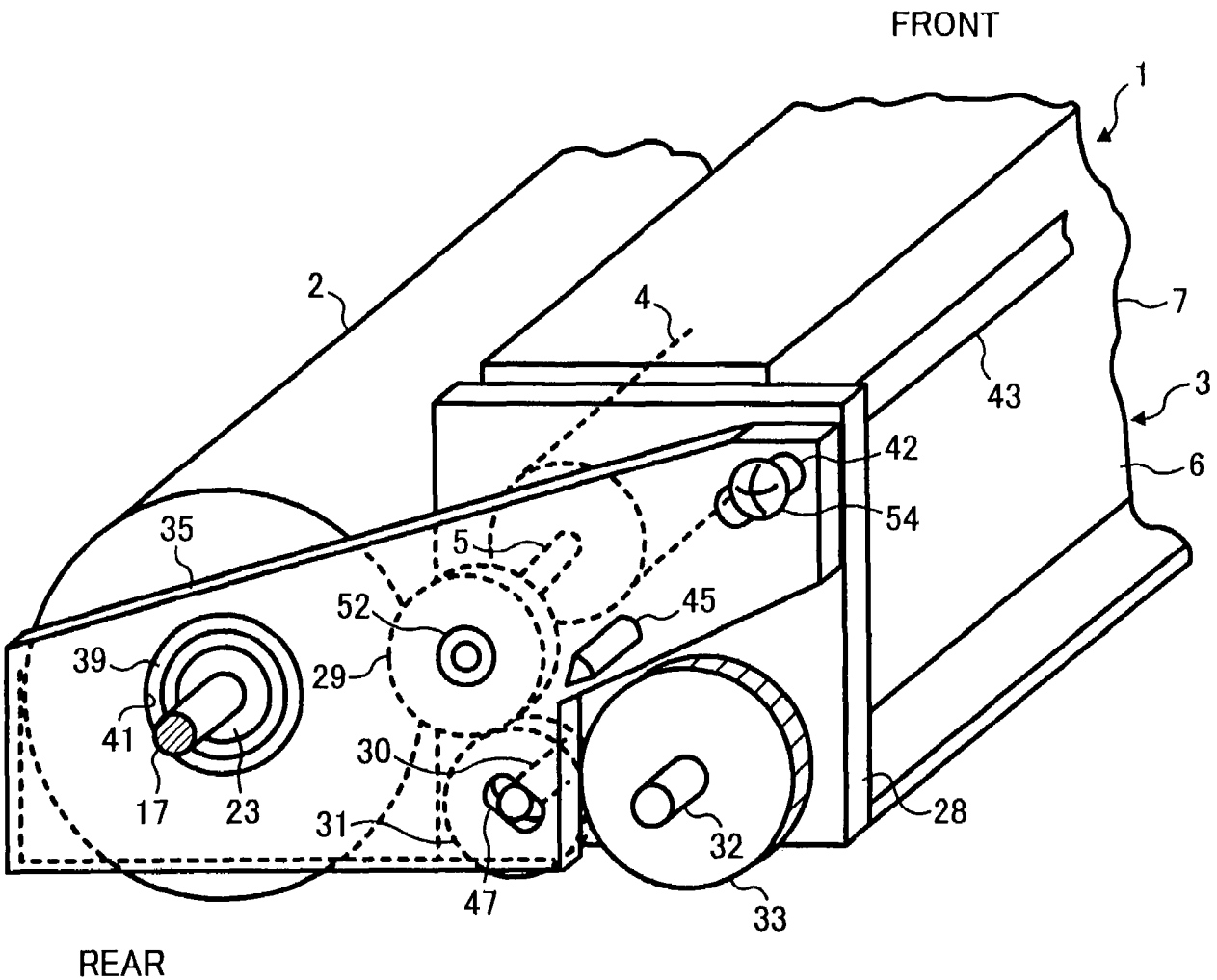
FIG. 3 is a perspective view of a process cartridge of FIG. 2, which is seen from a rear side of a process cartridge.
Figure 4:
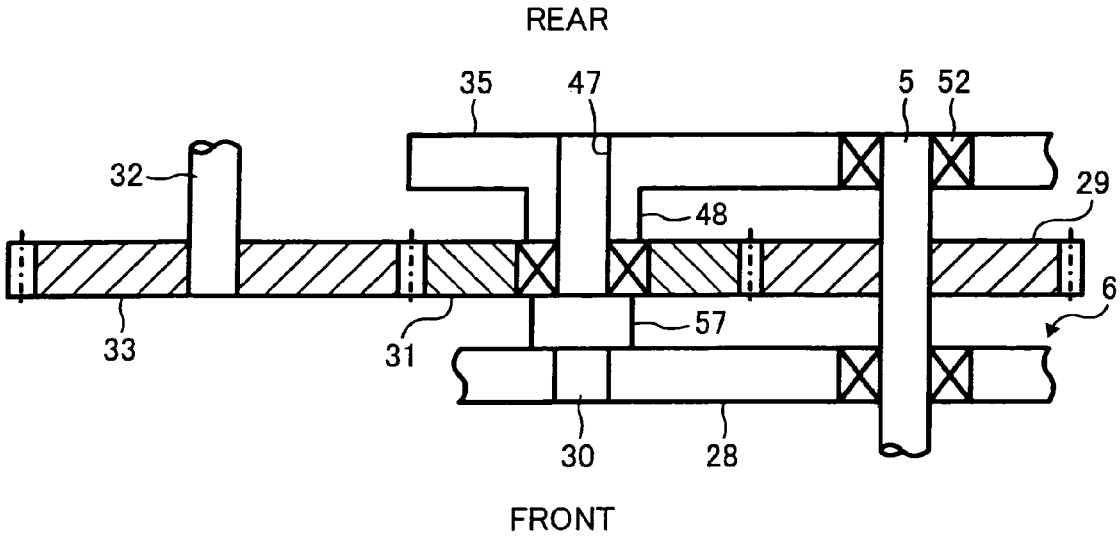
FIG. 4 is a schematic view explaining a teeth engagement of a rotating gear, an idler gear, and a main gear of an image forming apparatus according to an example embodiment.

In FIGS. 2, 3, and 4, a reference character FRONT represents a front side of a body 14 of an image forming apparatus, and a reference character REAR represents a rear side of the body 14 of the image forming apparatus.

FIG. 3 is a perspective view of the process cartridge 1 which is viewed from a rear side of the image forming apparatus.

As shown in FIG. 2, each end of the drum-shaped image carrying member 2 is pressingly covered by a front-side flange 15 and a rear-side flange 16.

Each of the front-side flange 15 and rear-side flange 16 has a center hole, through which a drive shaft 17 of the image carrying member 2 is inserted, thereby the image carrying member 2 is supported by the front-side flange 15 and rear-side flange 16 via the drive shaft 17.

The drive shaft 17 is rotatably supported by bearings at a rear-side panel 18 and a support panel 19 fixed to the rear-side panel 18 in a rear side of the body 14 of the image forming apparatus.

At a front side of the body 14 of the image forming apparatus, a front-side panel 20 having an opening 21 is provided. The opening 21 is covered by a cover panel 22.

The drive shaft 17 is rotatably supported by a bearing at the cover panel 22, which is a front side of the image forming apparatus. The cover panel 22 is detachably fixed to the front-side panel 20 with a correct positioning.

Therefore, the image carrying member 2 can be correctly positioned in the body 14 of the image forming apparatus.

As shown in FIG. 2, the image forming apparatus includes a front door panel 50 in front of the front-side panel 20.

The rear side flange 16 has the center hole having a number of teeth thereon. Such teeth mesh with teeth 24 formed on an engagement member 23 fixed to the drive shaft 17.

Furthermore, a gear 25 is fixed to a rear side of the drive shaft'17 as shown in FIG. 2. The gear 25 meshes with a driver gear 26, which is rotatably supported by the rear-side panel 18 and the support panel 19 as shown in FIG. 2.

When the driver gear 26 is driven and rotated by a motor (not shown), such rotation is transmitted to the drive shaft 17 via the gear 25.

Then, rotation of the drive shaft 17 is transmitted to the image carrying member 2 via the engagement member 23 and the rear side flange 16.

The image carrying member 2 then rotates in the counterclockwise direction shown in FIG. 1, and the above-mentioned image forming operation is conducted.

As shown in FIG. 2, the unit body 6 of the developing unit 3 includes a front end plate 27 and a rear end plate 28 at a front and rear side of the unit body 6, respectively.

The shaft 5 of the developing roller 4 is rotatably supported by bearings provided to the front end plate 27 and rear end plate 28.

As shown in FIG. 2, at a rear side of the shaft 5, a rotating gear 29 is fixed on the shaft 5.

As shown in FIG. 3, an idler shaft 30 is fixed to the rear end plate 28, which is at a rear side of the unit body 6.

The idler gear 31 can be rotatably supported by a bearing provided on the idler shaft 30, and such idler gear 31 can mesh with the above-mentioned rotating gear 29.

In another configuration, the idler gear 31 can be fixed to the idler shaft 30, and the idler shaft 30 is rotatably supported by the unit body 6.

In both cases, the idler gear 31 is rotatably supported by the unit body 6 via the idler shaft 30.

Although not shown in the drawings, a plurality of idler gears, which mesh with each other, can be provided.

As above-mentioned, the developing unit 3 is configured as a rotatable unit, and the developing unit 3 includes the rotating gear 29 fixed to the shaft 5 of the developing roller 4 (i.e., rotating member) and the idler gear 31, rotatably supported to the unit body 6 via the idler shaft 30.

As shown in FIG. 2, the body 14 of the image forming apparatus includes the rear-side panel 18 and the support panel 19 which rotatably support a main output shaft 32 via bearings.

A main gear 33 is fixed to the main output shaft 32, and the main gear 33 meshes with the idler gear 31 as shown in FIG. 3. The main output shaft 32 can be driven by a motor (not shown).

As such, the rotating gear 29 is coupled to the main gear 33 via the idler gear 31. The number of the idler gear 31 is not limited to one but a plurality of idler gears can be used.

When the above-mentioned motor (not shown) is activated to drive the main gear 33, the main gear 33 starts to rotate. Such rotation is transmitted to the shaft 5 of the developing roller 4 via the idler gear 31 and rotating gear 29.

Then the developing roller 4 is rotated in the clockwise direction shown in FIG. 1 to conduct the above-mentioned developing operation.

FIG. 4 shows a schematic view explaining a teeth engagement of the rotating gear 29, the idler gear 31, and the main gear 33.

As shown in FIGS. 2 and 3, at an outside portion of both end side of the unit body 6, positioning members 34 and 35 are provided.

With the positioning members 34 and 35, the image carrying member 2 and the shaft 5 of the developing roller 4 can be positioned with a predetermined distance between each other, As shown in FIG. 2, cylindrical portions 36 and 37 are provided to the front side flange 15 and rear side flange 16 fixed on each end portion of the image carrying member 2, respectively. The cylindrical portions 36 are provided concentrically with the drive shaft 17.

Each positioning member 34 and 35 has a hole 40 and 41, respectively.

The outer surface of the each cylindrical portion 36 and 37 detachably engage with the hole 40 and 41 via bearings 36 and 39, respectively.

In this manner, the positioning members 34 and 35 engage with the holes 40 and 41, respectively.

As shown in FIG. 2, the shaft 5 of the developing roller 4 is also rotatably supported by the positioning members 34 and 35 via bearings 51 and 52, respectively.

With such configuration, the image carrying member 2 and the developing roller 4 are positioned with a predetermined distance with each other.

In addition, as for the positioning member 35 at a rear side of the body 14, a sub-reference hole 42 having a slot-like shape is formed.

A sub-reference pin 43 is inserted in the sub-reference hole 42, and fixed to the unit body 6 as below.

As also shown in FIG. 2, as for the positioning member 34 at a front side of the body 14, a sub-reference hole 53 having a slot-like shape is formed.

The sub-reference pin 43 is also inserted in the sub-reference hole 53, and fixed to the unit body 6 as below.

As such, the sub-reference pin 43 is inserted in the sub-reference hole 42 and 53 formed in the positioning members 34 and 35, and fixed to the unit body 6. With such configuration, rotation of the unit body 6 itself around the shaft 5 of the developing roller 4 can be prevented.

Therefore, the image carrying member 2 and the developing roller 4 can be correctly positioned with a predetermined distance with respect to each other to integrally configure the process cartridge 1.

In addition, a distance between an axis of the shaft 17 of the image carrying member 2 and an axis of the shaft 5 of the developing roller 4 can be correctly controlled.

Therefore, when the image carrying member 2 and the developing roller 4 is arranged each other with a small gap between them as shown in FIG. 2, such gap can be correctly maintained.

When the image carrying member 2 and the developing roller 4 is arranged while contacting each other, the contact pressure can be correctly controlled.

In both cases, the image carrying member 2 can form a toner image having a higher quality.

As for the process cartridge 1, as shown in FIG. 2, each of the positioning members 34 and 35 includes the sub-reference holes 53 and 42, and screws 44 and 54 are inserted to the sub-reference holes 53 and 42, respectively.

The screws 44 and 54 are then screwed to female screws (not shown) formed on the sub-reference pin 43 to fix the sub-reference pin 43 to the positioning members 34 and 35. In this manner, the unit body 6 and the positioning members 34 and 35 can be fixed.

With such fixed configuration, tilting of the idler shaft 30 due to a deflection of the unit body 6 can be prevented. Thus a shaft-to-shaft distance change between the idler gear 31 and the rotating gear 29 or main gear 33 can be prevented.

Therefore, unevenness of teeth engagement of the gears can be prevented, whereby the image carrying member 2 can form a toner image having a higher image quality.

In addition, in the process cartridge 1, the sub-reference pin 43 engages with the sub-reference hole 53 and 42, formed on the positioning member 34 at the front side of the body 14 and the positioning member 35 at the rear side of the body 14, respectively.

The sub-reference pin 43 thus extends substantially parallel to the shaft 5 of the developing roller 4. With such configuration, a shaft-to-shaft distance change between the idler gear 31 and the main gear 33 due to a deflection of the unit body 6 can be prevented. Thereby the image carrying member 2 can form a toner image having a higher image quality.

As above described, the front side flange 15 and rear side flange 16 fixed to the image carrying member 2 engage the drive shaft 17, which is rotatably supported by the body 14 of the image forming apparatus, whereby the image carrying member 2 can be correctly positioned in the body 14 of the image forming apparatus.

In addition, as shown in FIGS. 2 and 3, a positioning pin 45 protruded from the positioning member 35 at the rear side of the image forming apparatus engages with a positioning hole 55, formed in the rear-side panel 18 of the body 14 of the image forming apparatus, and a positioning pin 46 protruded from the positioning member 34 at the front side of the image forming apparatus engages with a positioning hole 56, formed in the cover panel 22.

Thereby, rotation of the process cartridge 1 itself around the shaft 17 of the image carrying member 2 can be prevented.

Therefore, the process cartridge 1 can be correctly positioned in the body 14 of the image forming apparatus.

The process cartridge 1 can be detached from the body 14 of the image forming apparatus as below.

At first, the front door panel 50 shown in FIG. 2 is opened. Then the cover panel 22 is removed from the front-side panel 20. And then, the process cartridge 1 is removed in a direction indicated by an arrow B so that the process cartridge 1 can be removed to a front side.

At this time, the drive shaft 17 remains in the image forming apparatus, and the idler gear 31 of the process cartridge 1 disengages from the main gear 33 of the image forming apparatus.

As such, the process cartridge 1 is removed from the image forming apparatus.

Then the positioning members 34 and 35 can be removed from the image carrying member 2 and the developing unit 3. Subsequently, the image carrying member 2 and the developing unit 3 can be separated.

On one hand, in an operation which reverses the above-described removal sequence, the process cartridge 1 can be correctly positioned in the image forming apparatus.

The process cartridge 1 may include a guide groove (not shown) formed thereon, and the body 14 of the image forming apparatus may include a guide rail (not shown) formed thereon.

Such guide groove and guide rail engage each other, and when the process cartridge 1 is moved in a front side direction or rear side direction, the guide groove slides along the guide rail.

When an image forming operation is conducted in the image forming apparatus having the process cartridge 1 as above-mentioned, the main gear 33 applies an external force to the idler gear 31 when the main gear 33 rotates.

Figure 5:
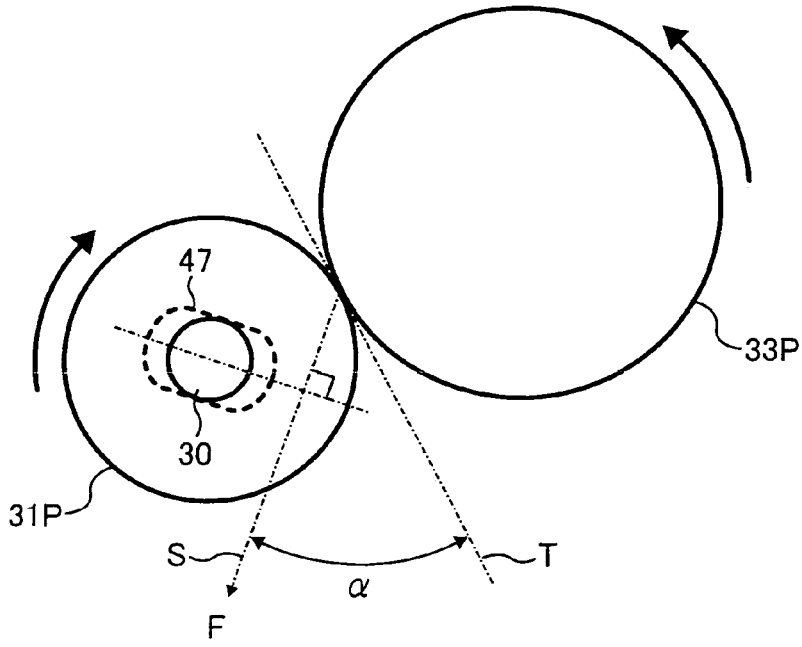
FIG. 5 is a schematic view explaining how a force is applied from a main gear to an idler gear.

In FIG. 5, reference character 33P is a pitch circle of the main gear 33, and reference character 31P is a pitch circle of the idler gear 31.

When the main gear 33 rotates, the main gear 33 applies an external force F to the idler gear 31 in a direction of line of action S, which has a pressure angle a with respect to common tangent T of the pitch circles 31P and 33P.

In such configuration, the idler shaft 30 may be periodically deformed by the external force F and vibrate, and such vibration may be transmitted to the image carrying member 2, and thereby banding may occur on a toner image formed on the image carrying member 2.

In the process cartridge 1, as shown in FIGS. 3 to 5, a free end portion of the idler shaft 30 engages with an absorbing hole 47 formed in the positioning member 35 to support the idler shaft 30 by the positioning member 35.

With such configuration, the idler shaft 30 can be supported by the positioning member 35 even if the external force F is transmitted to the idler gear 31 from the main gear 33 when the main gear 33 rotates.

As shown in FIG. 5, when the main gear 33 rotates, the main gear 33 applies the external force F to the idler gear 31 in a direction of line of action S, which has a pressure angle $\alpha$ with respect to common tangent T of the pitch circles 31P and 33P.

However, a longitudinal direction of the absorbing hole 47 formed in the positioning member 35 is substantially perpendicular to the direction of external force F so that the external force F may not deform the idler shaft 30.

Because the idler shaft 30 is supported by the positioning member 35 in such configuration, deformation of the idler shaft 30 due to the external force can be prevented.

With such configuration, a vibration of the idler shaft 30 due to the external force F from the main gear 0.33 to the idler gear 31 can be prevented effectively, whereby banding on a toner image formed on the image carrying member 2 can be prevented.

When a plurality of idler gears meshing together are rotatably supported by the unit body 6 via each idler shaft, each idler shaft can be configured to be supported by the positioning member 35 even when an external force F is applied to each idler gear.

In this manner, a high quality image can be obtained by the image forming apparatus according to an example embodiment.

In the process cartridge 1, as shown in FIG. 4, one end of the idler shaft 30 is fixed to the unit body 6. The idler gear 31 is rotatably supported by the idler shaft 30 via a bearing.

Accordingly, the idler gear 31 can be prevented from moving in a shaft line direction of the idler shaft 30 by the positioning member 35, whereby the idler gear 31 can be positioned at a predetermined position in the shaft line direction of the idler shaft 30.

As shown in FIG. 4, the positioning member 35 includes a boss 48.

The boss 48 and a flange 57 of the idler shaft 30 contact the idler gear 31 so that the idler gear 31 is prevented from moving in a shaft line direction of the idler shaft 30.

With such configuration, a special device to position the idler gear 31 in the shaft line direction of the idler shaft 30 can be omitted, whereby the cost of process cartridge 1 can be reduced.

In the above-described example embodiment, the process cartridge 1 having the image carrying member 2 and the developing unit 3 is used. However, other process unit can be included in the process cartridge 1. For example, the cleaning unit 9 shown in FIG. 1 can be coupled to the image carrying member 2 so that the process cartridge 1 includes the cleaning unit 9 as one element.

In the above example embodiment, the process cartridge 1 includes the developing roller 4 as a rotating member, and the developing unit 3 as a rotatable unit, and the image carrying member 2 forms a toner image thereon with the developer D supplied by the developing roller 4. However, other process cartridges can be configured.

For example, the process cartridge 1 can include the cleaning brush 11 shown in FIG. 1 as a rotating member, and the cleaning unit 9 as a rotatable unit.

In such configuration of the process cartridge 1, toners remaining on the image carrying member 2 can be removed by the cleaning brush 11 after transferring a toner image from the image carrying member 2.

Hereinafter, another example embodiment is explained with reference to FIGS. 6 to 15.

When an image forming operation is conducted, the image carrying member 2 rotates to a counterclockwise direction as shown in FIG. 1.

The image carrying member 2 is charged to a predetermined polarity with a charging roller 8. Then a writing beam L, emitted from a exposing device (not shown), irradiates a surface of the image carrying member 2 charged to the predetermined polarity to form an electrostatic latent image on the image carrying member 2.

On the one hand, the developing roller 4 in the developing unit 3 rotates to a clockwise direction as shown in FIG. 1. At this time, the developing roller 4 carries the developer D on its surface.

The developer D is then transferred on the surface of the image carrying member 2 to develop the electrostatic latent image as a toner image.

A sheet feed unit (not shown) feeds a transfer sheet P in a direction indicated by an arrow "A" as shown in FIG. 1. The toner image is transferred to the transfer sheet P with an effect of a transfer roller 13.

The transfer sheet P is then transported to a fixing unit (not shown), in which heat and pressure are applied to the transfer sheet P so that the toner image is fixed on the transfer sheet P.

Although not shown in FIG. 1, an image forming apparatus can assume a configuration such that a toner image on the image carrying member 2 is transferred to an intermediate transfer member (not shown) at first, and then transferred to a final transfer member (,not shown).

After transferring the toner image to the transfer sheet P, toners remaining on the image carrying member 2 are removed by a cleaning unit 9. The cleaning unit 9 includes an unit body 10, a cleaning brush 11, and a cleaning blade 12.

The unit body 10 supports the cleaning brush 11 rotatably, and also supports the cleaning blade 12.

With a collaborative effect of the cleaning brush 11 and the cleaning blade 12, toners remaining on the image carrying member 2 are removed.

In an example embodiment, the unit body 10 of the cleaning unit 9 is used as cleaning case.

Figure 6:
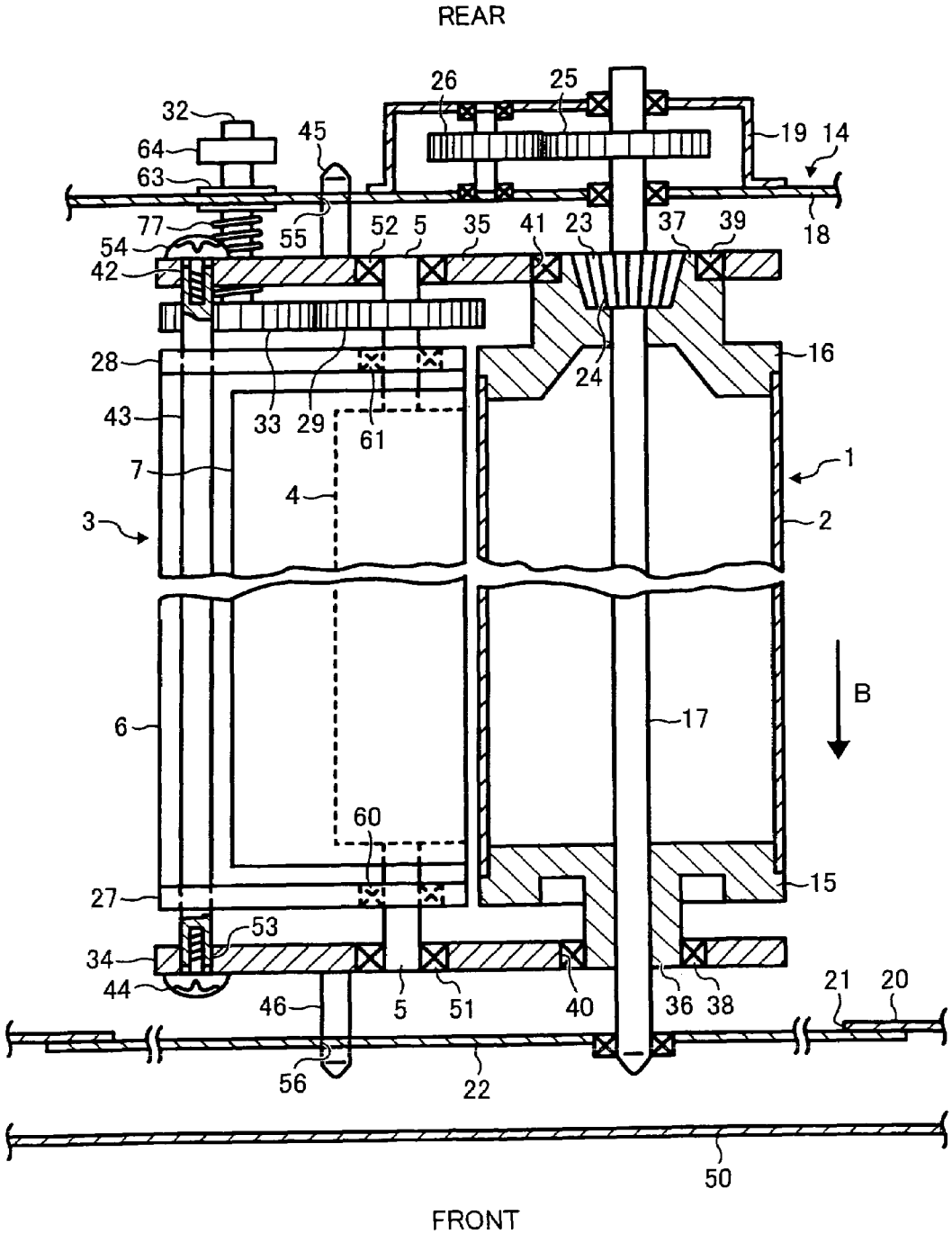
FIG. 6 is a schematic horizontal sectional view of another process cartridge according to another example embodiment.

FIG. 6 is a schematic horizontal sectional view of the process cartridge 1 of FIG. 1, in which some components such as charging roller 8 and cleaning unit 9 are omitted.

In FIGS. 6 to 12, 14 and 15, the reference character or indication FRONT represents a front side of a body 14 of an image forming apparatus, and reference character REAR represents a rear side of the body of the image forming apparatus.

Figure 7:
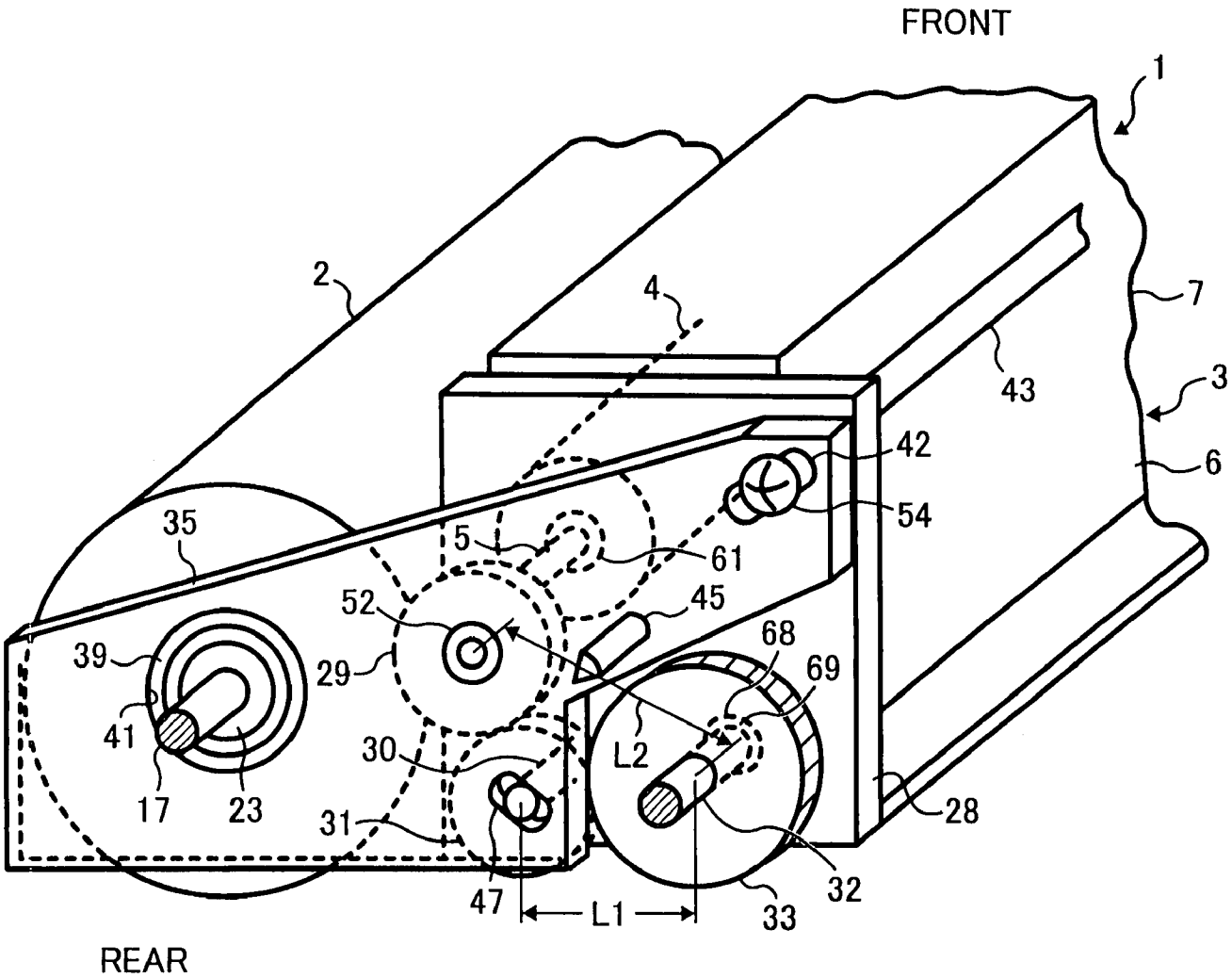
FIG. 7 is a perspective view of a process cartridge of FIG. 6, which is seen from a rear side of a process cartridge.

FIG. 7 is a perspective view of the process cartridge 1 which is viewed from a rear side of the image forming apparatus.

As shown in FIG. 6, each end of the drum-shaped image carrying member 2 is pressingly covered by a front-side flange 15 and a rear-side flange 16.

Each of the front-side flange 15 and rear-side flange 16 has a center hole, through which a drive shaft 17 for the image carrying member 2 is inserted, whereby the image carrying member 2 is supported by the front-side flange 15 and rear-side flange 16 via the drive shaft 17.

The drive shaft 17 is rotatably supported by bearings at a rear-side panel 18 and a support panel 19 fixed to the rear-side panel 18 in a rear side of the body 14 of the image forming apparatus.

At a front side of the body 14 of the image forming apparatus, a front-side panel 20 having an opening 21 is provided. The opening 21 is covered by a cover panel 22.

The drive shaft 17 is rotatably supported by a bearing at the cover panel 22, which is a front side of the image forming apparatus. The cover panel 22 is detachably fixed to the front-side panel 20 with a correct positioning.

Therefore, the image carrying member 2 can be correctly positioned in the body 14 of the image forming apparatus.

As shown in FIG. 6, the image forming apparatus includes a front door panel 50 in front of the front-side panel 20.

The rear side flange 16 has the center hole having a number of teeth thereon. Such teeth mesh with teeth 24 formed on an engagement member 23 fixed to the drive shaft 17.

Furthermore, a gear 25 is fixed to a rear side of the drive shaft 17. The gear 25 meshes with a driver gear 26, which is rotatably supported by the rear-side panel 18 and the support panel 19 as shown in FIG. 6.

When the driver gear 26 is driven and rotated by a motor (not shown), such rotation is transmitted to the drive shaft 17 via the gear 25.

Then, rotation of the drive shaft 17 is transmitted to the image carrying member 2 via the engagement member 23 and the rear side flange 16.

Then, the image carrying member 2 rotates in the counterclockwise direction shown in FIG. 1, and the above-mentioned image forming operation is conducted.

As shown in FIG. 6, the unit body 6 of the developing unit 3 includes a front end plate 27 and a rear end plate 28 at front and rear side of the unit body 6, respectively.

The shaft 5 of the developing roller 4 is rotatably supported by bearings 60 and 61 provided to the front end plate 27 and rear end plate 28 and positioned in a predetermined position in the unit body 6. In this manner, the unit body 6 rotatably supports the shaft 5 of the developing roller 4 and positions the shaft 5 in the predetermined position.

As shown in FIG. 6, at a rear side of the shaft 5, a rotating gear 29 is fixed on the shaft 5.

Figure 8:
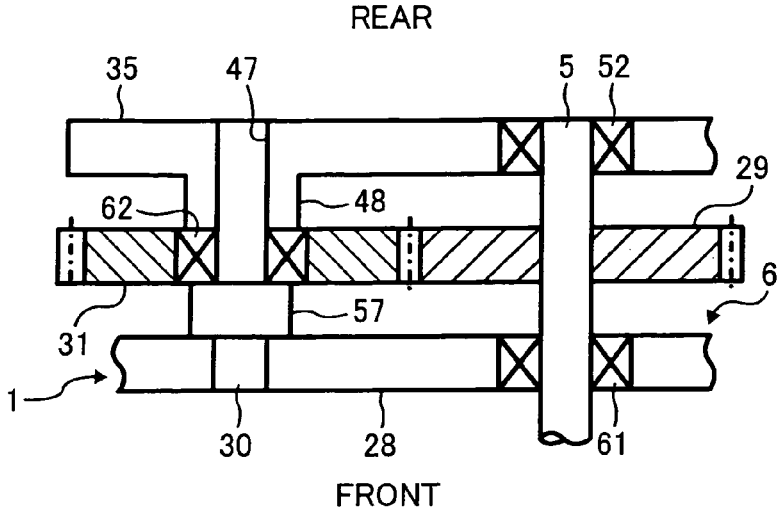
FIG. 8 is a schematic view explaining a teeth engagement of a rotating gear, and an idler gear according to another example embodiment.

As shown in FIGS. 7 and 8, an idler shaft 30 is fixed to the rear end plate 28, which is at a rear side of the unit body 6.

The idler gear 31 can be can be rotatably supported by a bearing 62 provided on the idler shaft 30, and such idler gear 31 can mesh with the above mentioned rotating gear 29.

In other configuration, the idler gear 31 can be fixed to the idler shaft 30, and the idler shaft 30 can be rotatably supported by the unit body 6.

In both cases, the idler gear 31 is rotatably supported by the unit body 6 via the idler shaft 30.

Although not shown in the drawings, a plurality of idler gears, which mesh each other, can be provided, as required.

As above-mentioned, the developing unit 3 is configured as a rotatable unit, and the developing unit 3 includes the rotating gear 29 fixed to the shaft 5 of the developing roller 4 (i.e., rotating member) and the idler gear 31, rotatably supported by the unit body 6 via the idler shaft 30.

Figure 9:
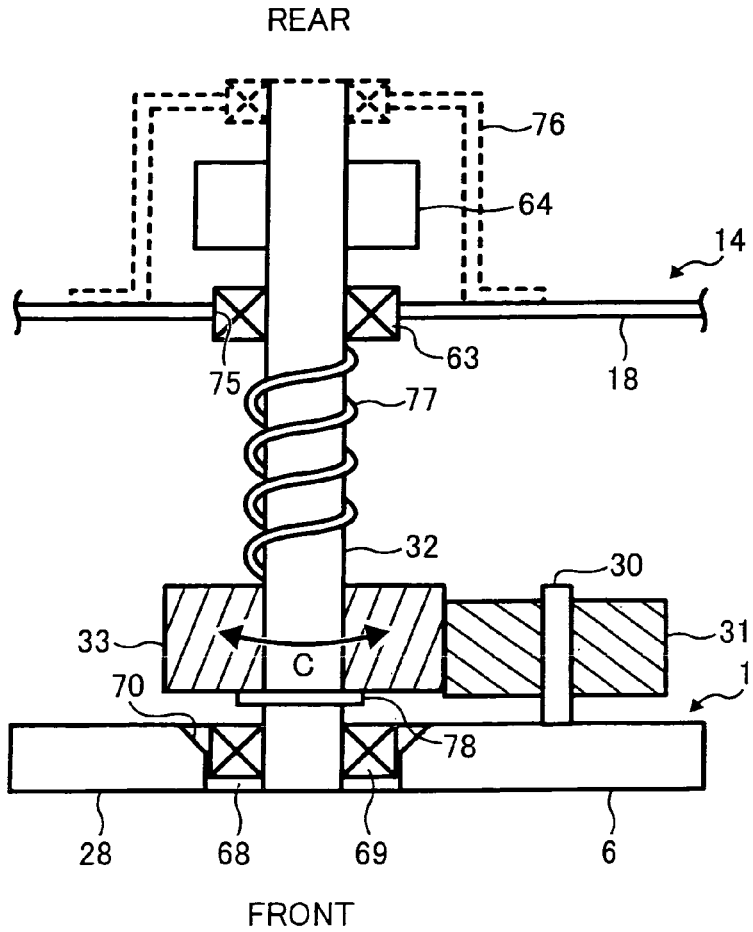
FIG. 9 is a schematic view explaining a positional relationship of a process cartridge and an output shaft of an image forming apparatus when another process cartridge is attached in an image forming apparatus.

As shown in FIG. 9, the body 14 of the image forming apparatus includes the-rear-side panel 18 having a reference attachment hole 75, at which a main output shaft 32 is rotatably supported via a bearing 63.

A main gear 33 can be fixed to the main output shaft 32, and the main gear 33 meshes with the idler gear 31 when the process cartridge 1 is attached in a predetermined position in the body 14 of the image forming apparatus as shown in FIG. 7. The main output shaft 32 can be driven by a motor (not shown).

In an exemplary embodiment shown in FIG. 7, the main gear 33 is attached to the main output shaft 32 while movable along a shaft line direction of the main output shaft 32 although the main gear 33 does not rotate around the main output shaft 32. This will be explained in detail later.

As above-mentioned, in the image forming apparatus according to another example embodiment shown in FIG. 6, the rotating gear 29 is coupled to the main gear 33 via one idler gear 31.

On one hand, the image forming apparatus can assume a configuration that provides a plurality of idler gears 31 rotatably supported to the unit body 6 via idler shafts, and the rotating gear 29 can be coupled to the main gear 33 via the idler gears.

In another case, the rotating gear 29 can be coupled to the main gear 33 directly without providing an idler gear.

In either case, the rotating gear 29 is coupled to the main gear 33 when the process cartridge 1 is attached in the body 14 of the image forming apparatus.

In FIG. 6, the main output shaft 32 is driven by a driving motor provided in the image forming apparatus.

Figure 13:
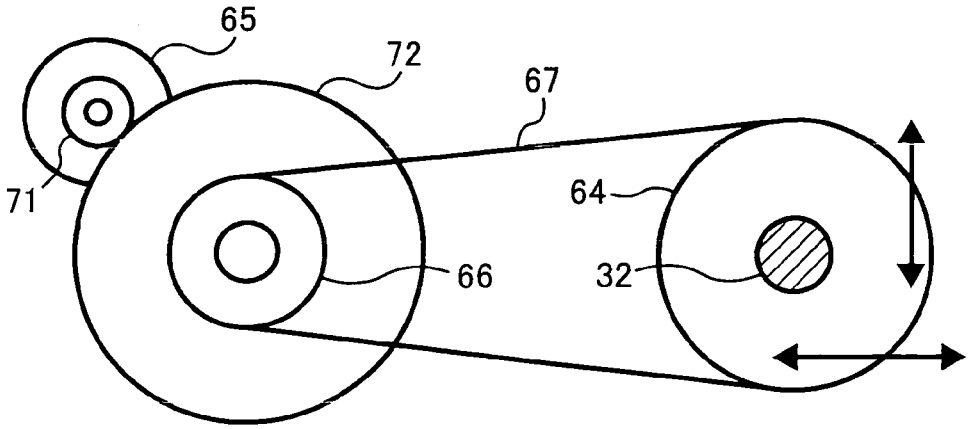
FIG. 13 is a schematic view for a driving force transmission system, which transmits a driving force from a driving motor to an output shaft of an image forming apparatus.

As shown in FIGS. 6, 9, and 13, a pulley 64 is fixed to the main output shaft 32.

As shown in FIG. 13, a driving motor 65 provided in the image forming apparatus has an output shaft fixed with a driving gear 71. The driving gear 71 meshes with a gear 72. The gear 72 has a shaft fixed with a drive-side pulley 66.

As shown in FIG. 13, a timing belt 67 is extended by the pulley 64 and the drive-side pulley 66.

When the driving motor 65 rotates, such rotation is transmitted to the main output shaft 32 via the gears 71 and 72, the drive-side pulley 66, the timing belt 67 and the pulley 64.

In such a way, the driving motor 65 drives the main output shaft 32 to rotate the main output shaft 32.

Rotation of the main output shaft 32 is transmitted to the shaft 5 of the developing roller 4 via the main gear 33, idler gear 31, and rotating gear 29.

Then the developing roller 4 rotates in the clockwise direction shown in FIG. 1, and the above-mentioned developing operation can be conducted.

If the idler gear is not provided, the main gear 33 directly meshes with the rotating gear 29, and the main gear 33 transmits a rotation to the rotating gear 29.

As shown in FIGS. 6 and 7, at an outside portion of both end side of the unit body 6, positioning members 34 and 35 are provided.

With the positioning members 34 and 35, the image carrying member 2 and the shaft 5 of the developing roller 4 can be positioned with a predetermined distance each other.

As shown in FIG. 6, cylindrical portions 36 and 37 are provided to the front side flange 15 and rear side flange 16 fixed on each end portion of the image carrying member 2, respectively. The cylindrical portions 36 are provided concentrically with the drive shaft 17.

Each positioning member 34 and 35 has a hole 40 and 41, respectively.

The outer surface of each of cylindrical portion 36 and 37 detachably engage with the hole 40 and 41 via bearings 38 and 39, respectively.

In this manner, the positioning members 34 and 35 engage with the holes 40 and 41, respectively.

As shown in FIG. 6, the shaft 5 of the developing roller 4 is also rotatably supported by the positioning members 34 and 35 via bearings 51 and 52, respectively.

With such configuration, the image carrying member 2 and the developing roller 4 are positioned with a predetermined distance with each other.

In addition, as for the positioning member 35 at a rear side of the body 14, a sub-reference hole 42 having a slot-like shape is formed.

A sub-reference pin 43 is inserted in the sub-reference hole 42, and fixed to the unit body 6 as below.

As also shown in FIG. 6, as for the positioning member 34 at a front side of the body 14, a sub-reference hole 53 having a slot-like shape is formed.

A sub-reference pin 43 is also inserted in the sub-reference hole 53, and fixed to the unit body 6 as below.

As such, the sub-reference pin 43 is inserted in the sub-reference hole 42 and 53 formed in the positioning members 34 and 35, and fixed to the unit body 6. With such configuration, a rotation of the unit body 6 itself around the shaft 5 of the developing roller 4 can be prevented.

Therefore, the image carrying member 2 and the developing roller 4 can be correctly positioned with a predetermined distance with respect to each other to integrally configure the process cartridge 1.

In addition, a distance between an axis of the shaft 17 of the image carrying member 2 and an axis of the shaft 5 of the developing roller 4 can be correctly controlled.

Therefore, when the image carrying member 2 and the developing roller 4 is arranged each other with a small gap between them as shown in FIG. 6, such gap can be correctly maintained.

When the image carrying member 2 and the developing roller 4 is arranged while contacting each other, a contact pressure can be correctly controlled.

In both cases, the image carrying member 2 can form a toner image having a higher quality.

As for the process cartridge 1, as shown in FIG. 6, each of the positioning members 34 and 35 includes the sub-reference holes 53 and 42, and screws 44 and 54 are inserted to the sub-reference holes 53 and 42, respectively.

The screws 44 and 54 is then screwed to female screws (not shown) formed on the sub-reference pin 43 to fix the sub-reference pin 43 to the positioning members 34 and 35. In this manner, the unit body 6 and the positioning members 34 and 35 can be fixed.

With such fixed configuration, tilting of the idler shaft 30 due to a deflection of the unit body 6 can be prevented. Thus a shaft-to-shaft distance change between the idler gear 31 and the rotating gear 29 or main gear 33 can be prevented.

Therefore, unevenness of teeth engagement of the gears can be prevented, whereby the image carrying member 2 can form a toner image having a higher image quality.

In addition, in the process cartridge 1, the sub-reference pin 43 engages with the-sub-reference hole 53 and 42, formed on the positioning member 34 at the front side of the body 14 and the positioning member 35 at the rear side of the body 14, respectively.

Thereby the sub-reference pin 43 extends substantially parallel to the shaft 5 of the developing roller 4. In other words, the front side and rear side of the sub-reference pin 43 are concentrically positioned.

With such configuration, a shaft-to-shaft distance change between the idler gear 31 and the main gear 33 due to a deflection of the unit body 6 can be prevented. Thereby, the image carrying member 2 can form a toner image having a higher image quality.

As above-mentioned, the front side flange 15 and rear side flange 16 fixed to the image carrying member 2 engage the drive shaft 17, which is rotatably supported by the body 14 of the image forming apparatus, whereby the image carrying member 2 can be correctly positioned in the body 14 of the image forming apparatus.

In addition, as shown in FIGS. 6 and 7, a positioning pin 45 protruded from the positioning member 35 at the rear side of the image forming apparatus engages with a positioning hole 55, formed in the rear-side panel 18 of the body 14 of the image forming apparatus, and a positioning pin 46 protruded from the positioning member 34 at the front side of the image forming apparatus engages with a positioning hole 56, formed in the cover panel 22.

As a result, rotation of the process cartridge 1 around the shaft 17 of the image carrying member 2 can be prevented.

Therefore, the process cartridge 1 can be correctly positioned in the body 14 of the image forming apparatus.

The process cartridge 1 can be detached from the body 14 of the image forming apparatus as below.

At first, the front door panel 50 shown in FIG. 6 is opened. Then the cover panel 22 is removed from the front-side panel 20. Subsequently, the process cartridge 1 is removed in a direction indicated by an arrow B so that the process cartridge 1 can be removed to a front side.

At this time, the drive shaft 17 remains in the image forming apparatus, and the idler gear 31 of the process cartridge 1 disengages from the main gear 33 of the image forming apparatus.

As such, the process cartridge 1 is removed from the image forming apparatus.

Then the positioning members 34 and 35 can be removed from the image carrying member 2 and the developing unit 3. Subsequently, the image carrying member 2 and the developing unit 3 can be separated.

On one hand, with an operation which reverses the above-mentioned removal sequence, the process cartridge 1 can be correctly positioned in the image forming apparatus.

The process cartridge 1 may include a guide groove (not shown) formed thereon, and the body 14 of the image forming apparatus may include a guide rail (not shown).

Such guide groove and guide rail engage each other, and when the process cartridge 1 is moved in a front side direction or rear side direction, the guide groove slides along the guide rail.

In the process cartridge 1, as shown in FIGS. 7 and 8, a free end portion of the idler shaft 30 engages with an elongated absorbing hole 47 formed in the positioning member 35 to support the idler shaft 30 by the positioning member 35.

With such configuration, the idler shaft 30 can be supported by the positioning member 35 even if the external force F is transmitted to the idler gear 31 from the main gear 33 when the main gear 33 rotates.

As shown in FIG. 5, when the main gear 33 rotates, the main gear 33 applies the external force F to the idler gear 31 in a direction of line of action S, which has a pressure angle a with respect to common tangent of the pitch circles 31 P and 33P.

However, a longitudinal direction of the absorbing hole 47 formed in the positioning member 35 is substantially perpendicular to the direction of external force F so that the external force F may not deform the idler shaft 30.

Because the idler shaft 30 is supported by the positioning member 35 in such configuration, deformation of the idler shaft 30 due to the external force can be prevented.

With such configuration, vibration of the idler shaft 30 due to the external force from the main gear 33 to the idler gear 31 can be prevented effectively, and therefore banding on a toner image formed on the image carrying member 2 can be prevented.

When a plurality of idler gears meshing together are rotatably supported by the unit body 6 via idler shafts, each idler shaft can be configured to be supported by the positioning member 35 even when an external force is applied to each idler gear.

In this way, a high quality image can be obtained by the image forming apparatus of an example embodiment.

In the process cartridge 1, as shown in FIG. 8, one end of the idler shaft 30 is fixed to the unit body 6. The idler gear 31 is rotatably supported by the idler shaft 30 via a bearing 62.

Accordingly, the idler gear 31 can be prevented from moving in a shaft line direction of the idler shaft 30 by the positioning member 35, whereby the idler gear 31 can be positioned at a predetermined position in the shaft line direction of the idler shaft 30.

As shown in FIG. 8, the positioning member 35 includes a boss 48.

The boss 48 and a flange 57 of the idler shaft 30 contact the idler gear 31 so that the idler gear 31 is prevented from moving in a shaft line direction of the idler shaft 30.

With such configuration, a special device to position the idler gear 31 in the shaft line direction of the idler shaft 30 can be omitted, whereby the cost of process cartridge 1 can be reduced.

In the above-mentioned image forming apparatus, the shaft 5 fixed to the rotating gear 29 and the idler shaft 30 fixed to the idler gear 31 are rotatably supported by the unit body 6 of the developing unit 3, and the main gear 33 is fixed to the main output shaft 32 supported by the body 14 of the image forming apparatus.

In the above-mentioned configuration, a center-to-center distance of meshed gears may fluctuate due to an accumulation of assembly tolerances of each shaft.

Specifically, when the idler gear 31 is provided as shown in FIG. 7, the center-to-center distance L1 between the idler gear 31 and the main gear 33 may fluctuate.

When the idler gear 31 is not provided, the rotating gear 29 meshes with the main gear 33 directly, and the center-to-center distance L2 between the rotating gear 29 and the main gear 33 may fluctuate.

If the center-to-center distance of the meshed gears 31 and 33, or the meshed gears 29 and 33 deviates from a adequate value significantly, an unevenness may occur in a rotation transmission, and result in vibration of gears.

Such vibration can be transmitted to the image carrying member 2, whereby the image carrying member 2 may form a toner image having a degraded image quality.

To cope with such drawbacks, as for the image forming apparatus according to another example embodiment, as shown in FIGS. 7 and 9, a reference hole 68 is formed in the end plate 28, which is at a rear side of the unit body 6.

When the process cartridge 1 is attached in the body 14 of the image forming apparatus, one end portion of the main output shaft 32 engages with the reference hole 68 via a bearing 69 so that the main output shaft 32 is rotatably supported at the reference hole 68.

In addition, as above-mentioned, the idler shaft 30 and the shaft 5 of the developing roller 4 are positioned in the unit body 6 with a predetermined position.

When a plurality of idler gears are provided, each idler shaft fixed to each idler gear is positioned in the unit body 6 with a predetermined position.

In this manner, the main output shaft 32 fixed to the main gear 33 and the idler shaft 30 fixed to the idler gear 31 are positioned in the unit body 6 with predetermined positions.

Therefore, the center-to-center distance L1 between the idler gear 31 and the main gear 33 may not fluctuate due to an accumulation of dimensional tolerances, thereby the distance L1 can be maintained at a predetermined value with a higher precision.

Similarly, when the idler gear 31 is not provided, the center-to-center distance L2 between the rotating gear 29 and the main gear 33 can be maintained to a predetermined dimension with a higher precision.

With such configuration, uneven rotation transmission during gear rotation can be prevented, and consequently vibration of the gear can be prevented, thereby the image carrying member 2 can form a toner image with high image quality.

As shown in FIGS. 6 and 9, the main output shaft 32 is rotatably supported by the rear-side panel 18 of the body 14 of the image forming apparatus via a bearing 63.

In addition to such configuration, a support plate 76 can be fixed to the rear-side panel 18 as shown by a dotted line in FIG. 9 to support the main output shaft 32 in the image forming apparatus more securely.

More specifically, the main output shaft 32 is rotatably supported by the support plate 76, fixed to the rear-side panel 18, via a bearing, for example.

In such a configuration, the main output shaft 32 is positioned and supported at two points in the body 14 of the image forming apparatus.

However, if such configuration is used, the main output shaft 32 is actually positioned and supported at three points because the output shaft 32 is also supported at the reference hole 68 of the unit body 6 via the bearing 69.

Because aligning of each axis of the three bearings is hard to attain, the main output shaft 32 may be deformed by the three bearings.

If the main output shaft 32 is deformed, rotation of the main output shaft 32 may show some unevenness, whereby the image carrying member 2 may form a toner image having uneven concentration.

Therefore, in the image forming apparatus according to another example embodiment, as shown in FIG. 9, one portion of the main output shaft 32 is rotatably supported by the reference attachment hole 75, formed in the rear-side panel 18, via the bearing 63, and other portion of the main output shaft 32 is rotatably supported by the reference hole 68 formed in the unit body 6 of the process cartridge 1 via the bearing 69.

As such, one portion of the main output shaft 32 is rotatably supported by the body 14 of the image forming apparatus, and other portion of the main output shaft 32 is rotatably supported to the reference hole 68 when the process cartridge 1 is attached in the body 14 of the image forming apparatus.

In the above-mentioned configuration, the main output shaft 32 is supported at two points, and thus the main output shaft 32 may not deflect significantly.

Therefore, the main output shaft 32 may not show a rotation unevenness, whereby the image carrying member 2 can form a high quality toner image having less concentration unevenness.

If the main output shaft 32 can be supported at two points, the main output shaft 32 may not deflect significantly even if the bearings 63 and 69 have some concentricity deviation with respect to each other.

In addition, because the main output shaft 32 is supported at two points, the main output shaft 32 can be favorably supported.

If the main output shaft 32 is supported at one point by the body 14 of the image forming apparatus as above-mentioned, the main output shaft 32 may move slightly in a direction indicated by an arrow C shown in FIG. 9 with respect to the bearing 63 when the process cartridge 1 is not attached in the image forming apparatus.

Therefore, when attaching the process cartridge 1 to the body 14 of the image forming apparatus, the main output shaft 32 may not be correctly engaged with the reference hole 68 of the unit body 6.

In the image forming apparatus according to another example embodiment, the above-mentioned main gear 33 is supported by the main output shaft 32 while the main gear 33 can be moved in a shaft line direction of the main output shaft 32, and a compression coil spring 77 is winded around the main output shaft 32 as shown in FIG. 9.

The compression coil spring 77 biases the main gear 33 in a direction to the process cartridge 1, which is attached in the body 14 of the image forming apparatus.

As shown in FIG. 9, the main gear 33 biased by the compression coil spring 77 is received and stopped at a stopper 78, which is attached to the main output shaft 32.

Figure 10:
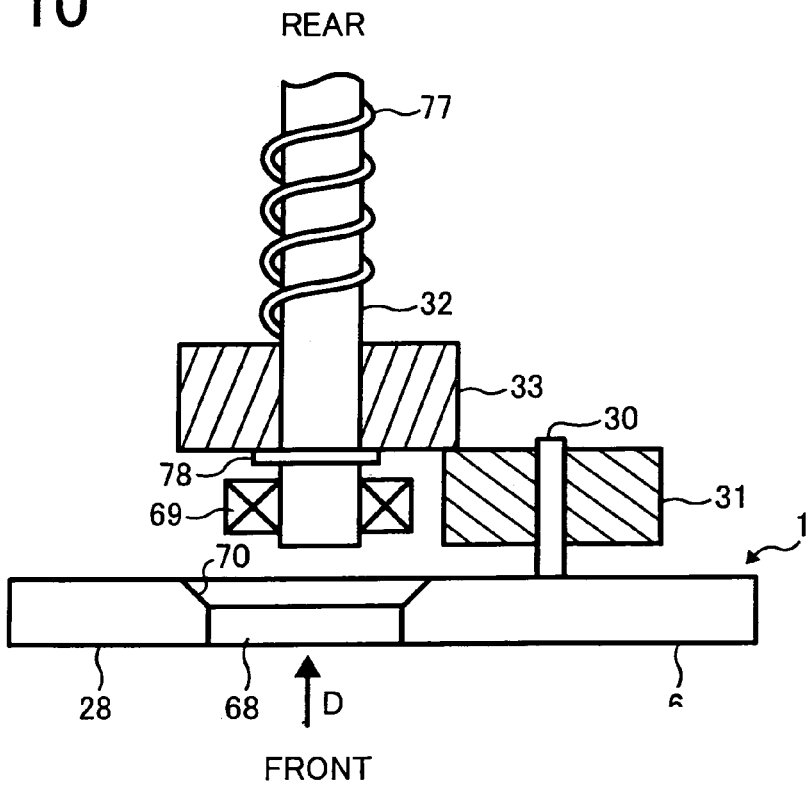
FIG. 10 is a schematic view explaining how a process cartridge of FIG. 6 is attached in an image forming apparatus by pushing the process cartridge into an image forming apparatus.

As shown in FIG. 10, the process cartridge 1 is pushed in a direction shown by an arrow D to attach the process cartridge 1 into the image forming apparatus.

In such process, the idler gear 31 may abut the main gear 33 because the main output shaft 32 may have some tilting with respect to the bearing 63 (FIG. 9).

Therefore, in this case, as the process cartridge 1 is pushed to a rear side direction, the compression coil spring 77 compressionally deforms itself, and the main gear 33 moves to a rear side direction with respect to the main output shaft 32.

In another example embodiment, the bearing 69 includes a ball bearing, for example, which is pressingly fit to the main output shaft 32 as shown in FIG. 10.

Figure 11:
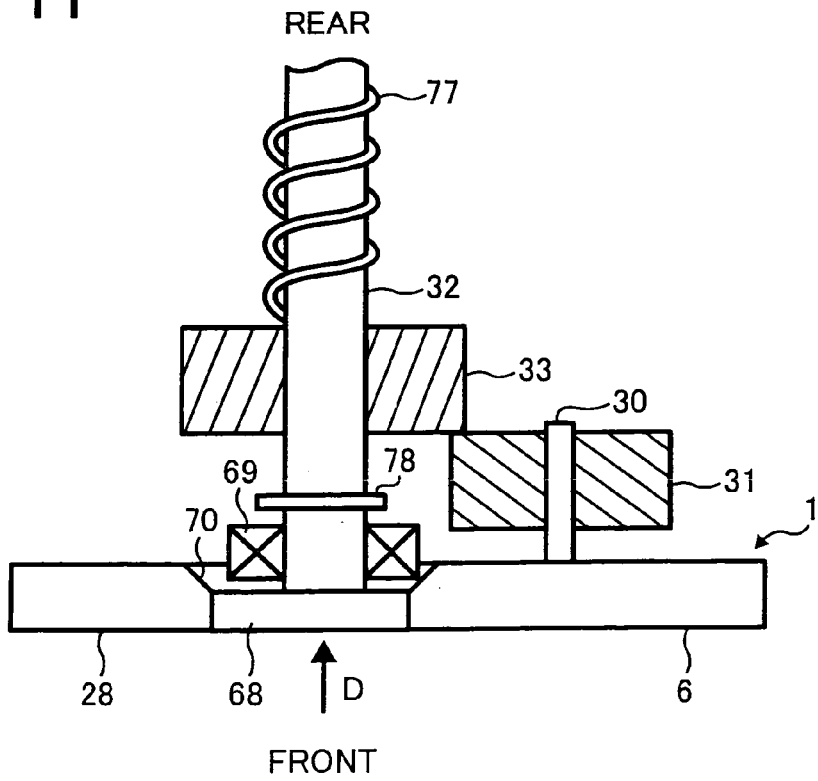
FIG. 11 is another schematic view explaining how a process cartridge of FIG. 6 is attached in an image forming apparatus by pushing the process cartridge into an image forming apparatus.

In FIG. 11, the bearing 69 starts to engage with the reference hole 68 formed in the unit body 6.

Figure 12:
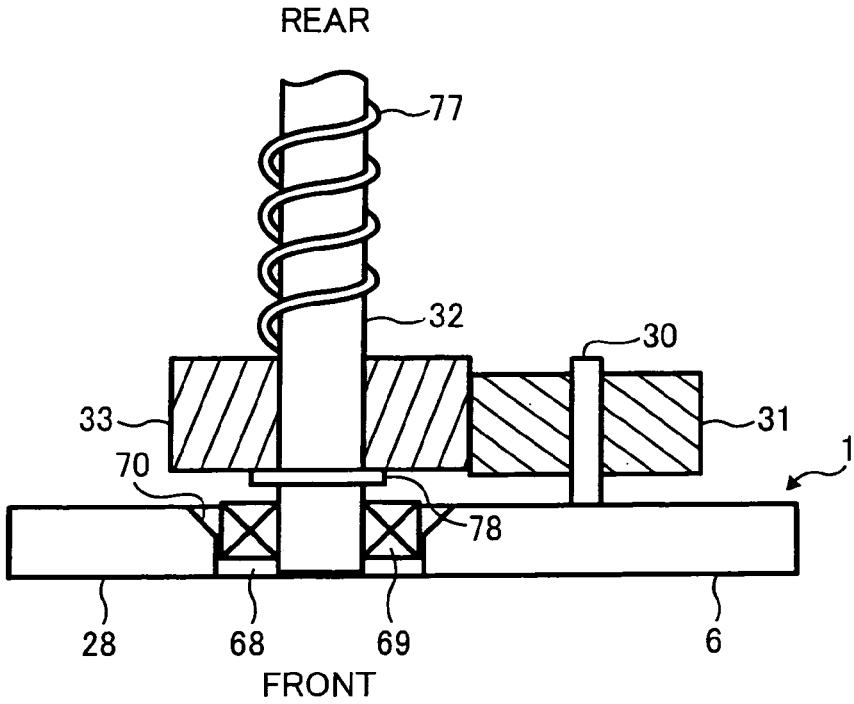
FIG. 12 is a schematic view explaining when a process cartridge of FIG. 6 is attached in an image forming apparatus.

In FIG. 12, the bearing 69 engages the reference hole 68, and the main output shaft 32 is positioned in the image forming apparatus, whereby tilting of the main output shaft 32 is corrected, thus resulting in no abutting of the main gear 33 and the idler gear 31.

The main gear 33 biased by the compression coil spring 77 is moved to a front side direction with respect to the main output shaft 32, and stopped by the stopper 78.

With such processes, the main output shaft 32 can be securely engaged to the reference hole 68.

In another case, the main gear 33 can be fixed to the main output shaft 32.

Figure 14:
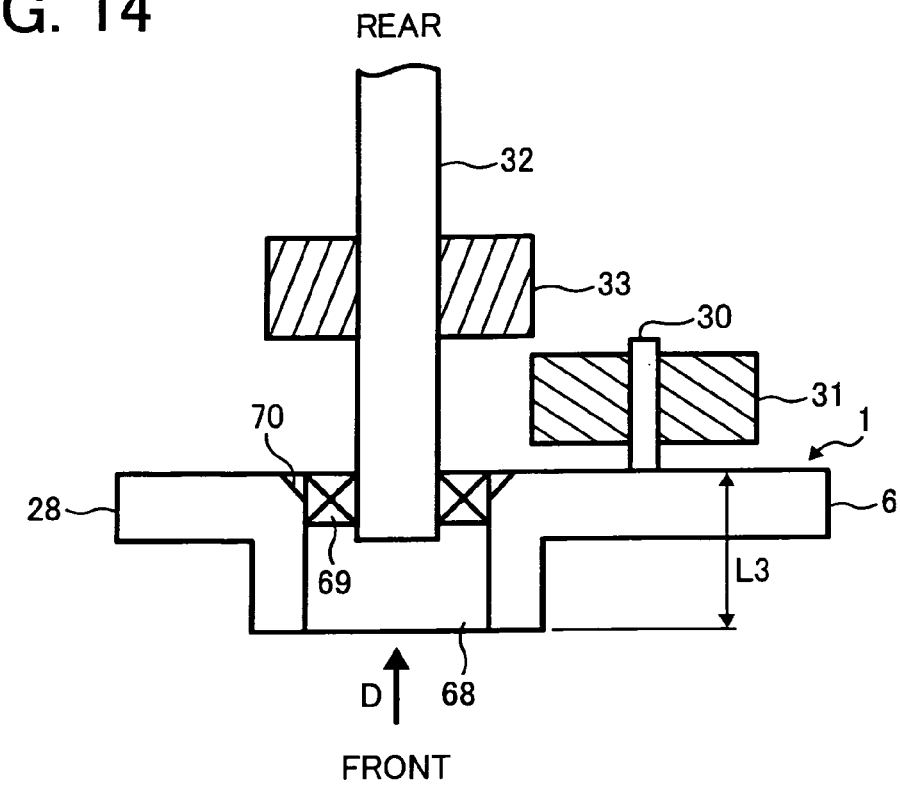
FIG. 14 is a schematic view explaining how another process cartridge is attached in an image forming apparatus by pushing another process cartridge into an image forming apparatus.
Figure 15:
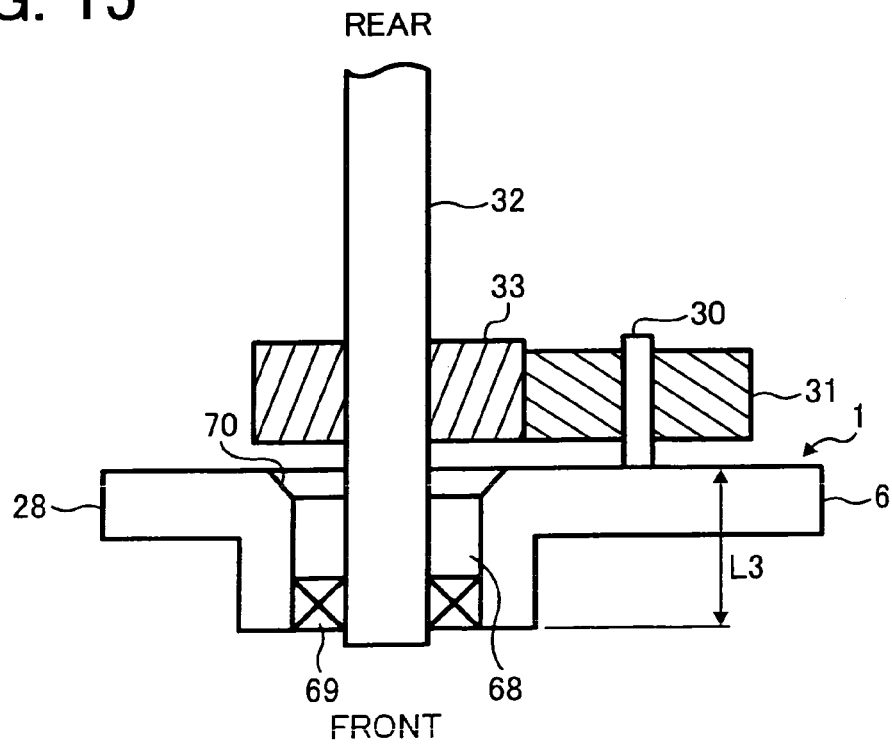
FIG. 15 a schematic view explaining when another process cartridge of FIG. 14 is attached in an image forming apparatus.

In such a case, as shown in FIGS. 14 and 15, a length L3 of the reference hole 68 formed in the unit body 6 may be set to relatively longer.

When the process cartridge 1 is pushed in a rear side direction indicated by an arrow D shown in FIG. 14, and the bearing 69 engages with the reference hole 68, a tilting of the main output shaft 32 can be corrected.

Therefore, as shown in FIG. 15, the main output shaft 32 can engage with the reference hole 68 without abutting the idler gear 31 to the main gear 33.

As such, the main output shaft 32 can be also engaged with the reference hole 68 with a configuration shown in FIG. 14 and FIG. 15.

However, such configuration includes a relatively longer length L3 for the reference hole 68, thereby the process cartridge 1 increase its cost and weight, which may not be observed in the image forming apparatus shown in FIGS. 9 to 12.

As explained with FIG. 13, a driving force transmitting mechanism includes the driving motor 65, the main output shaft 32, the pulley 64 fixed to the main output shaft 32, and the timing belt 67 extended by the pulley 64.

Therefore, even if the main output shaft 32 tilts to a direction shown by arrows in FIG. 13 when the process cartridge 1 is not attached in the image forming apparatus, the timing belt 67 can flexibly move in correspondence to such titling, whereby too large an external force may not be applied to elements for the driving force transmitting mechanism, and such elements may not be damaged.

As shown in FIGS. 9 to 12, 14, and 15, a chamfered portion 70 can be formed on an edge of the reference hole 68, which faces the main gear 33.

Therefore, when the process cartridge 1 is attached in the body 14 of the image forming apparatus, even if a tilting happened to the main output shaft 32, a front side end of the main output shaft 32 can be guided by the chamfered portion 70, and engaged to the reference hole 68 securely.

The main output shaft 32 engages the reference hole 68 via the bearing 69 provided to the main output shaft 32, whereby a sliding friction from the reference hole 68 to the main output shaft 32 during a rotation of the main output shaft 32 can be reduced.

Accordingly, a transmission rate of driving force can be improved.

In the above-described example embodiment, the process cartridge 1 having the image carrying member 2 and the developing unit 3 is used. However, other process unit can be included in the process cartridge 1. For example, the cleaning unit 9 shown in FIG. 1 can be coupled to the image carrying member 2 so that the process cartridge 1 includes the cleaning unit 9 as one element.

In the above example embodiment, the process cartridge 1 includes the developing roller 4 as a rotating member, and the developing unit 3 as a rotatable unit, and the, image carrying member 2 forms a toner image thereon with the developer D supplied by the developing roller 4. However, other process cartridge can be utilized.

For example, the process cartridge 1 can include the cleaning brush 11 shown in FIG. 1 as a rotating member, and the cleaning unit 9 as a rotatable unit. In such configuration of the process cartridge 1, toners remaining on the image carrying member 2 can be removed by the cleaning brush 11 after transferring a toner image from the image carrying member 2.

Hereinafter, another exemplary embodiment is explained with reference to FIGS. 16 to 22.

Figure 16:
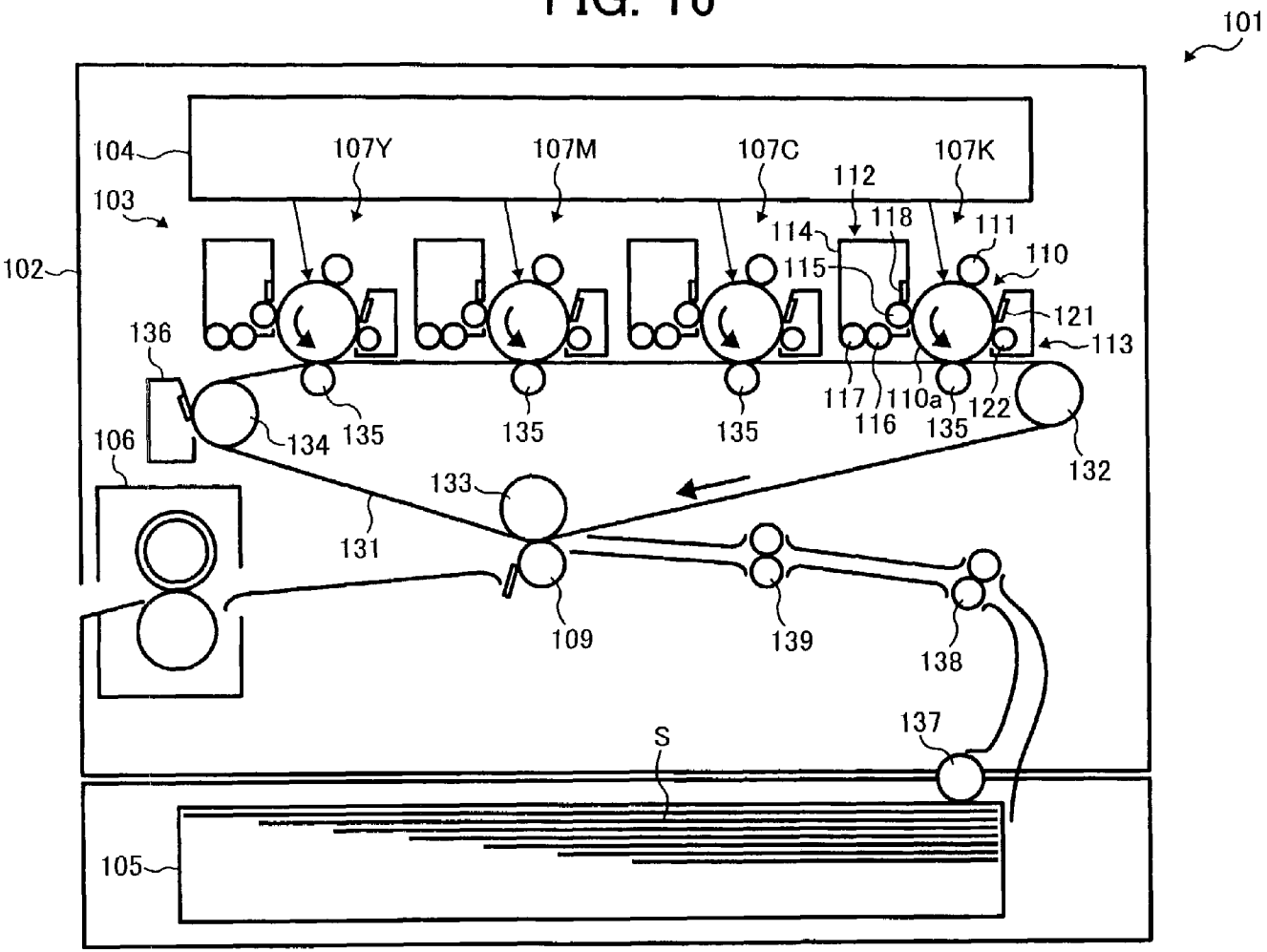
FIG. 16 is a schematic view illustrating an configuration of an image forming apparatus according to an example embodiment.

FIG. 16 is a schematic view illustrating a configuration of an image forming apparatus 101 of an example embodiment, wherein the image forming apparatus 101 includes a full color printer using electro-photography, for example.

The image forming apparatus 101 includes a body 102, an image forming section 103, an optical writing unit 104, a sheet feed cassette 105, and a fixing unit 106.

The image forming section 103 includes four image forming units 107Y, 107M, 107C, and 107K, an intermediate transfer unit below the image forming units 107, and a secondary transfer roller 109.

Reference characters Y, M, C, K represent yellow, magenta, cyan, black, respectively.

Each of the four image forming units 107Y, 107M, 1070, and 107K forms a toner image with respective color toner, and has a similar structure one another.

The image forming unit 107 includes a photoconductive member unit 110, a charging roller 111, a developing unit 112, and a cleaning unit 113.

The photoconductive member unit 110 includes photoconductive member 110*a* having a cylindrical shape (i.e., image carrying member which is rotatable)

Around the photoconductive member 110*a*, the charging roller 111, the developing unit 112, and the cleaning unit 113 is provided for electro photography.

The developing unit 112 and the cleaning unit 113 are used as driven units in an example embodiment.

The four photoconductive member 110*a* are substantially parallel to each other and spaced apart with substantially equal interval.

When conducting an image forming operation, the photoconductive member 110*a* can be driven by a motor (not shown).

The charging roller 111 contacts the photoconductive member 110*a*, and rotates with the photoconductive member 110*a*.

A high voltage power source (not shown) applies a power to the charging roller 111 with AC or DC bias voltage. By applying AC or DC bias voltage, the surface of the photoconductive member 110*a* can be uniformly charged to a predetermined voltage.

The developing unit 112 includes a developing case 114, and a developing sleeve 115. The developing sleeve 115 includes a magnet (not shown), for example.

The developing sleeve 115 is a roller, which carries developing agents to the photoconductive member 110*a*, and disposed in the developing case 114 and faces the photoconductive member 110*a* at an opening portion of the developing case 114.

The developing case 114 further includes a first transport screw 116, a second transport screw 117, and a doctor blade 118.

The developing case 114 contains two-component developing agent, which includes magnetic carrier and negatively-chargeable toner.

The first transport screw 116 and the second transport screw 117 agitate and transport the two-component developing agent to charge toners by friction. Then the developing agent is carried on the developing sleeve 115, which is rotating.

The doctor blade 118 controls a thickness of the developing agent on the developing sleeve 115.

Then the developing agent on the developing sleeve 115 is moved to a developing area which faces the photoconductive member 110*a*, and the photoconductive member 110*a* receives toners from the developing sleeve 115 on an electrostatic latent image to form a toner image on the photoconductive member 110*a*.

After the development, two-component developing agent is carried back to the developing case 114 with a rotation of the developing sleeve 115. A driving system of the developing sleeve 115 is explained later.

The cleaning unit 113 includes a cleaning blade 121 which can be made of polyurethane elastomer, for example, and pressed to the photoconductive member 110*a*.

The cleaning unit 113 further includes a fur brush 122 to improve cleaning-ability, wherein the fur brush 122 can be made of conductive material and contact the photoconductive member 110*a*. The fur brush 122 can be rotated by a motor (not shown).

The fur brush 122 applied with a bias voltage remove toners on the photoconductive member 110*a* when the fur brush 122 rotates.

Toners removed from the photoconductive member 110*a* by the cleaning blade 121 and fur brush 122 are stored in the cleaning unit 113.

Then, a recovery screw (not shown) collects toners in the cleaning unit 113, and then a toner recycle unit (not shown) transports toners back to the developing unit 112 for toner re-use.

The intermediate transfer unit includes an intermediate transfer belt 131 which is formed in a endless shape. The intermediate transfer belt 131 is extended by a drive roller 132, support rollers 133 and 134. The intermediate transfer belt 131 can be rotated by a motor (not shown), for example.

Along an internal surface of the intermediate transfer belt 131, four first transfer rollers 135 are provided in positions, which corresponds to each of the image forming units 107.

Specifically, each of the four first transfer rollers 135 faces a transfer position of the photoconductive member 110*a* via the intermediate transfer belt 131. The first transfer roller 135 is applied with a first transfer bias voltage.

With an effect of the first transfer roller 135, a toner image on the photoconductive member 110*a* is transferred to the intermediate transfer belt 131.

As shown in FIG. 16, on one side of the intermediate transfer unit, a cleaning unit 136 is provided to clean a surface of the intermediate transfer belt 131.

A secondary transfer roller 109 is provided in a position facing the support roller 133 via the intermediate transfer belt 131. The secondary transfer roller 109 is applied with a second transfer bias voltage.

With an effect of the secondary transfer roller 109, a toner image on the intermediate transfer belt 131 is transferred to on a transfer sheet S, sandwiched between the intermediate transfer belt 131 and the secondary transfer roller 109.

As shown in FIG. 16, the optical writing unit 104 can be provided over the image forming unit 107, for example.

The optical writing unit 104 emits a laser beam corresponding to an image data for each color of yellow, magenta, cyan, and black to the surface of the photoconductive member 110*a*, and forms an electrostatic latent image on the photoconductive member 110*a*.

The optical writing unit 104 may include a laser scan method using a laser beam source, polygon mirror, and another method which combines an LED (light emitting diode) array and a focusing device.

The sheet feed cassette 105 contains the transfer sheet S, and the transfer sheet S is separated and fed one by one by a pick-up roller 137.

Then the transfer sheet S is transported by a sheet feed roller 138 and a registration roller 139 to a transfer position defined by the support roller 133, the intermediate transfer belt 131, and the secondary transfer roller 109.

The fixing unit 106 applies heat and pressure to the transfer sheet S having a toner image to fix the toner image on the transfer sheet S.

Hereinafter, an image forming operation in the image forming apparatus 101 using electro-photocopying process is explained.

The optical writing unit 104 emits a laser beam, corresponding to an image data, from a semiconductor laser. When the laser beam is irradiated on the charged photoconductive member 110*x*, an electrostatic latent image is formed on the photoconductive member 110*a*.

The developing unit 112 supplies toners to the electrostatic latent image to form a toner image.

The toner image is transferred to the intermediate transfer belt 131, moving synchronizingly with the photoconductive member 110*x*, with an effect of the first transfer roller 135 being applied with the first transfer bias voltage.

After transferring the toner image to the intermediate transfer belt 131, toners remaining on the photoconductive member 110*a* is removed by the cleaning unit 113.

Then the photoconductive member 110*a* is discharged with a discharger (not shown) to prepare for a next image forming operation.

By superimposingly transferring toner images formed on each photoconductive member 110*a* to the intermediate transfer belt 131, a color toner image is formed on the intermediate transfer belt 131.

Then, the toner image on the intermediate transfer belt 131 is transferred to the transfer sheet S, which is fed from the sheet feed cassette 105 and transported to the transfer position defined by the secondary transfer roller 109 and the intermediate transfer belt 131.

With an effect of the secondary transfer roller 109 applied with the second transfer bias voltage, the toner image on the intermediate transfer belt 131 can be transferred to the transfer sheet S.

The transfer sheet S having received the color toner image receives a fixing process by the fixing unit 106.

After fixing the color toner image on the transfer sheet S, the transfer sheet S is ejected to an ejection tray (not shown) provided to the image forming apparatus 101.

Hereinafter, a process cartridge provided in the above-described configuration of the image forming apparatus 101 is explained with reference to FIG. 17 to FIG. 22.

Figure 17:
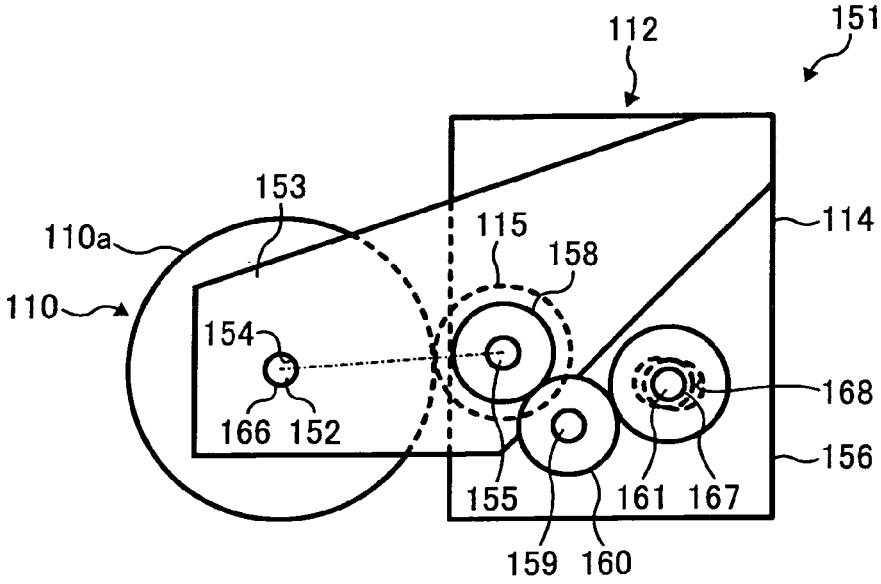
FIG. 17 is a side view of another process cartridge used in an image forming apparatus of FIG. 16.
Figure 18:
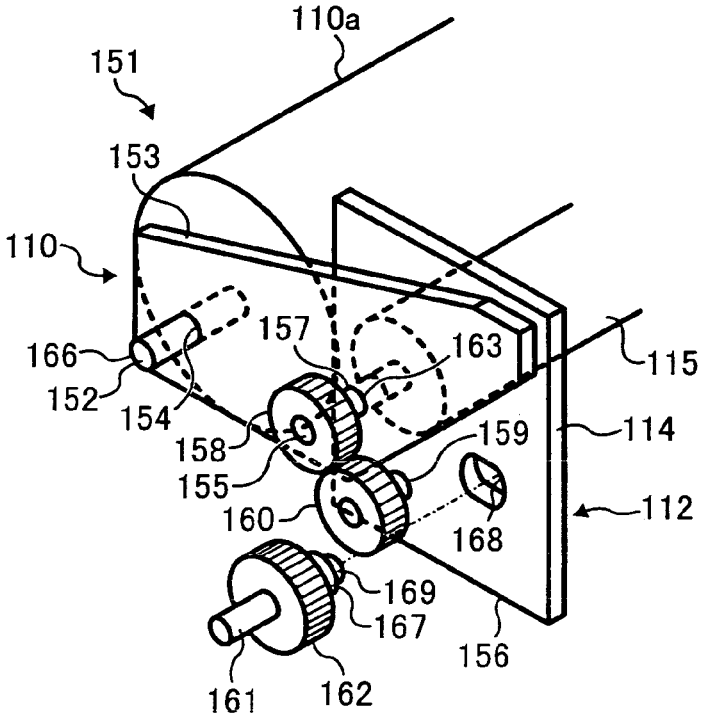
FIG. 18 is a schematic perspective view of another process cartridge of FIG. 17.

FIG. 17 is a side view of a process cartridge 151. FIG. 18 is a schematic perspective view of the process cartridge 151.

Figure 19:
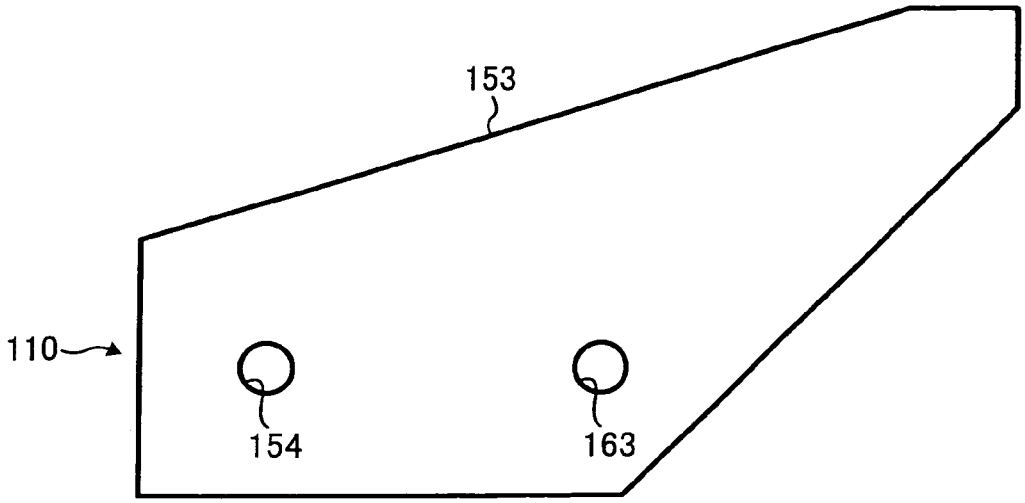
FIG. 19 is a schematic view of a support plate of a photoconductive member unit, in which the support plate is on the left side of a photoconductive member unit.

FIG. 19 is a schematic view of a support plate 153 of the photoconductive member unit 110, in which a support plate 153 is on the left side of the photoconductive member unit 110.

Figure 20:
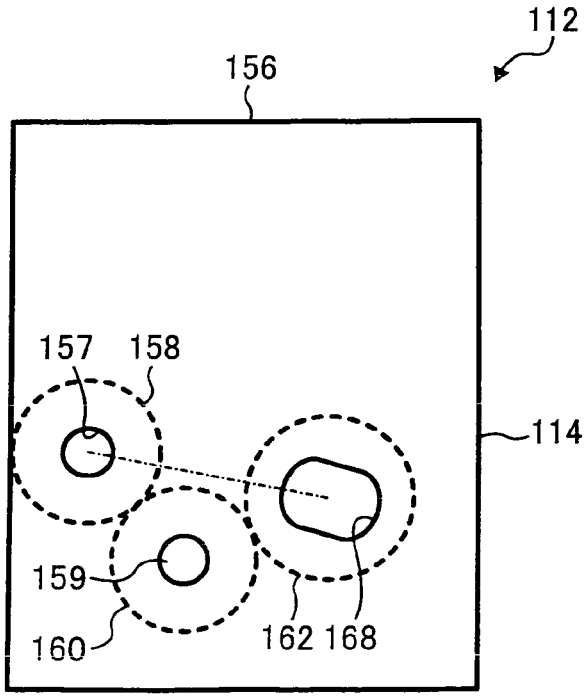
FIG. 20 is a schematic view of a support plate of a developing unit, in which the support plate is an the left side of a developing unit.

FIG. 20 is a schematic view of a support plate 156 of the developing unit 112, in which the support plate 156 is on the left side of the developing unit 112.

Figure 21:
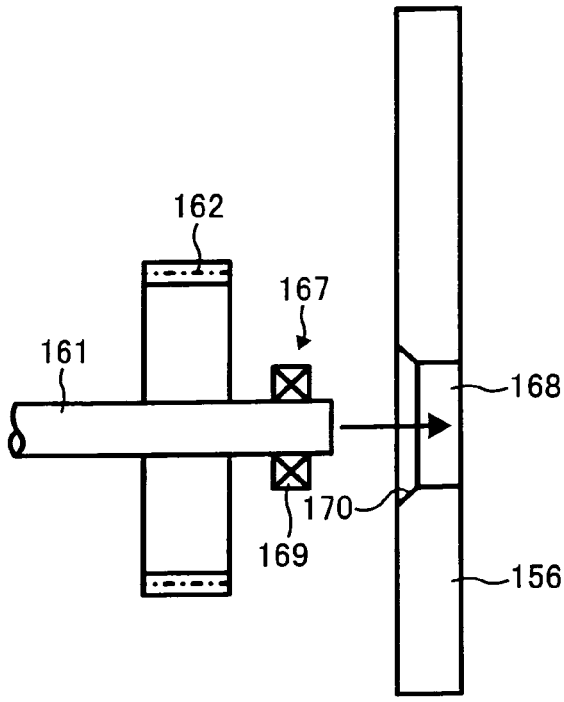
FIG. 21 is a schematic view explaining a relationship of a support plate of a developing unit and a driving unit.

FIG. 21 is a schematic view explaining a relationship of the support plate 156 of the developing unit 112 and a driving unit.

Figure 22:
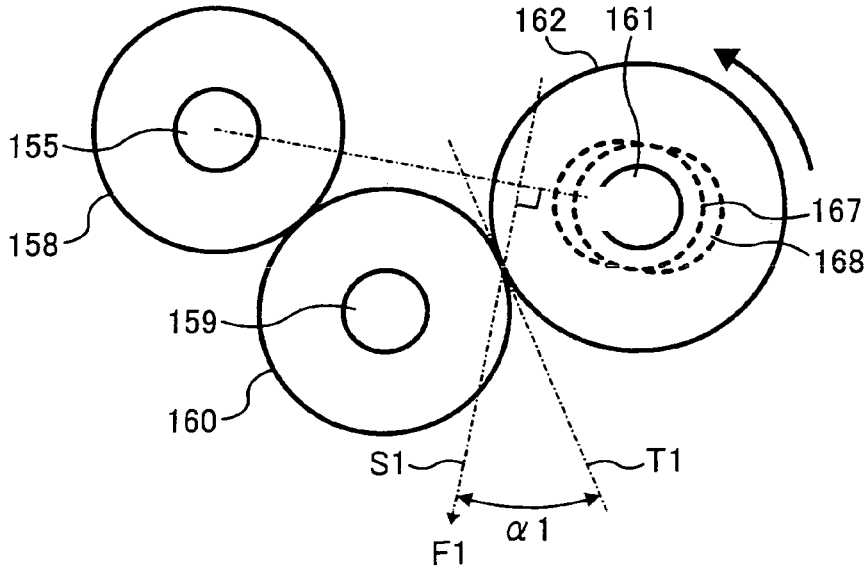
FIG. 22 is a schematic view explaining a driving configuration of a developing unit.

FIG. 22 is a schematic view explaining a driving configuration of the developing unit 112.

In another example embodiment according to FIGS. 16 to 22, the process cartridge 151 includes the photoconductive member unit 110 and the developing unit 112, wherein the developing unit 112 is detachable from the photoconductive member unit 110.

The photoconductive member unit 110 includes the photoconductive member 110*a* and a support plate 153.

The support plate 153 can be provided to each end side of the photoconductive member 110*a* to rotatably support a shaft 152 of the photoconductive member 110*a*. (Although not shown in FIG. 17, the support plate 153 can be provided to another end side of the photoconductive member 110*a*).

The support plate 153 includes a first support hole 154 to rotatably support the shaft 152 of the photoconductive member 110*a*.

The developing unit 112 includes the developing sleeve 115 and a support plate 156.

The support plate 156 can be provided to each end side of the developing case 114 to rotatably support a developing sleeve shaft 155 of the developing sleeve 115. (Although not shown in FIG. 17, the support plate 156 can be provided to another end side of the developing case 114).

The support plate 156 includes a second support hole 157 to rotatably support the developing sleeve shaft 155.

As shown in FIGS. 17 and 18, the developing sleeve gear 158 is fixed to one end (e.g., left end) of the developing sleeve shaft 155.

The developing sleeve gear 158 meshes with a idler gear 160, wherein the idler gear 160 is rotatably provided to an idler shaft 159 provided on the support plate 156 as shown in FIGS. 17 and 18.

The idler gear 160 meshes with a main gear 162, wherein the main gear 162 is fixed to a main output shaft 161 provided to the body 102 of the image forming apparatus-101. Thereby the idler gear 160 is coupled directly to the main gear 162.

Therefore, when a motor (not shown) rotates the main gear 162, such driving force is transmitted to the developing sleeve shaft 155 via the main gear 162, the idler gear 160, and the developing sleeve gear 158 to drive (i.e., rotate) the developing sleeve 115.

FIG. 18 shows a view in which the idler gear 160 and the main gear 162 are disengaged each other.

Hereinafter, an attachment of the developing unit 112 to the photoconductive member unit 110 is explained.

The support plate 153 of the photoconductive member unit 110 includes a third support hole 163 to rotatably support the end portion of the developing sleeve shaft 155 of the developing sleeve 115.

With such configuration, the developing sleeve shaft 155 is positioned with respect to the photoconductive member 110*a* with a predetermined position, whereby the distance between the developing sleeve shaft 155 and the shaft 152 of the photoconductive member 110*a* can be fixed to a predetermined distance.

Hereinafter, a method of positioning the process cartridge 151 in the body 102 of the image forming apparatus 101 is explained with reference to FIG. 18.

As shown in FIG. 18, an end portion of the shaft the shaft 152 of the photoconductive member 110*a* is used as a first supported portion 166. (Although not shown in FIG. 18, both end portion of the shaft 152 can be used as the first supported portion 166.)

The first supported portion 166 engages with a first supporting portion (not shown) formed in the in the body 102 of the image forming apparatus 101. Specifically, the first supporting portion (not shown) includes a bearing or the like for rotatably supporting the first supported portion 166, for example.

With such configuration, the shaft 152 of the photoconductive member 110*a* can be positioned adequately in the body 102 of the image forming apparatus 101.

The support plate 156 of the developing unit 112 includes a sub-reference hole 168 (absorbing hole 168) as a second supported portion.

The sub-reference hole 168 (i.e., the second supported portion) engages with a second supporting portion 167 formed at an end portion of the main output shaft 161 provided in the body 102 of the image forming apparatus 101.

Specifically, the second supporting portion 167 includes the main output shaft 161 and a bearing 169 provided on one end portion of the main output shaft 161 wherein the bearing 169 engages with the sub-reference hole 168 (absorbing hole 168) as shown in FIG. 21. Specifically, the bearing 169 includes a ball bearing or the like, for example.

As shown in FIG. 21, a chamfered portion 170 is formed (i.e., chamfered) on one side of the sub-reference hole 168 (absorbing hole 168). The chamfered portion 170 functions as a guide when the second supporting portion 167 is inserted into the sub-reference hole 168 (absorbing hole 168).

The sub-reference hole 168 (absorbing hole 168) is formed in slot-like shape, for example. The longitudinal direction of the sub-reference hole 168 (i.e., slot-like shape) goes in a direction to the photoconductive member 110*a* and the shaft center of the developing sleeve shaft 155.

With such arrangement, the sub-reference hole 168 (absorbing hole 168) can be used to reduce the effects of accumulated dimensional tolerances of each component.

Accordingly, in such a configuration, the shaft 152 of the photoconductive member 110*a* of the photoconductive member unit 110 is used as main reference, and the sub-reference hole 168 (absorbing hole 168) of the developing unit 112 is used as sub-reference to position the process cartridge 151 in the body 102 of the image forming apparatus 101 at a predetermined position.

Furthermore, as for the developing unit 112, the developing sleeve shaft 155 is used as main reference, and the sub-reference hole 168 (absorbing hole 168) is used as sub-reference to position the developing unit 112 in the body 102 of the image forming apparatus 101 at a predetermined position.

As above-mentioned, the supporting portion includes the first supporting portion (not shown) and the second supporting portion 167.

As shown in FIG. 22, a driving force is transmitted from the main gear 162, provided to the body 102 of the image forming apparatus 101, to the idler gear 160.

When the main gear 162 rotates, the main gear 162 applies an external force F1 to the idler gear 160 in a direction of line of action S1, which has a pressure angle $\alpha$1 with respect to a common tangent T1 defined by the idler gear 160 and the main gear 162.

The longitudinal direction of the sub-reference hole 168 (absorbing hole 168) is substantially perpendicular to the direction of external force F1 so that the external force F1 may not move the developing unit 112 as a whole (including the idler shaft 159 supporting the idler gear 160).

Specifically, the main gear 162 is disposed in a position with respect to the idler gear 160 so that the direction of line of action S1, which has the pressure angle $\alpha$1 with respect to the common tangent T1, becomes perpendicular with respect to the longitudinal direction of the sub-reference hole 168 (i.e., slot-like shape).

With such configuration, the process cartridge 151 can be positioned in the body 102 of the image forming apparatus 101 by using the shaft 152 of the photoconductive member 110*a* of the photoconductive member unit 110 and the sub-reference hole 168 (absorbing hole 168) of the support plate 156 of the developing unit 112, which is a driven unit.

Therefore, compared with a conventional positioning method, the positional accuracy of the photoconductive member 110*a* in the body 102 of the image forming apparatus 101 can be improved.

Furthermore, as above-mentioned, as for the developing unit 112, the developing sleeve shaft 155 of the developing sleeve 115 is used as main reference, and the sub-reference hole 168 (absorbing hole 168) is used as sub-reference to position the developing unit 112 in the body 102 of the image forming apparatus 101, thereby the positional accuracy of the developing unit 112 in the body 102 of the image forming apparatus 101 can be improved compared with a conventional positioning method.

Accordingly, a deviation of gear-to-gear pitch between the idler gear 160 and the main gear 162 can be prevented, and the idler gear 160 and the main gear 162 can be coupled in a favorable manner.

With such configuration, uneven rotation, and vibration due to a deviation of gear-to-gear pitch between the idler gear 160 and the main gear 162 can be prevented.

The sub-reference hole 168 (absorbing hole 168), functioning as second supported portion, is formed in slot-like shape. With such arrangement, the sub reference hole 168 (absorbing hole 168) can be used to reduce effects of accumulated dimensional tolerances of each component.

Furthermore, the sub-reference hole 168 (absorbing hole 168) is provided to the developing unit 112 as a sub-reference, thereby the main output shaft 161 provided to the body 102 of the image forming apparatus 101 can be used as a sub-reference pin.

Accordingly, a sub-reference can be provided to the developing unit 112 with a relatively simple configuration.

Furthermore, the sub-reference hole 168 (absorbing hole 168), functioning as a second supported portion, is formed in slot-like shape, and the longitudinal direction of the sub-reference hole 168 (i.e., slot-like shape) goes in a direction to the shaft center of the developing sleeve 115 (i.e., rotating member).

Furthermore, as shown in FIG. 22, a driving force is transmitted from the main gear 162 to the idler gear 160. When the main gear 162 rotates, the main gear 162 apply the external force F1 to the idler gear 160 in a direction of line of action S1, which has the pressure angle $\alpha$1 with respect to common tangent T1.

The longitudinal direction of the sub-reference hole 168 (absorbing hole 168) is set to a direction so that the external force F1 may not move the developing unit 112 as a whole (including the idler shaft 159 supporting the idler gear 160).

Furthermore, the chamfered portion 170 is formed (i.e., chamfered) on one side of the sub-reference hole 168 (absorbing hole 168), functioning as a second supported portion. The chamfered portion 170 functions as a guide when the second supporting portion 167 is inserted into the sub-reference hole 168 (absorbing hole 168).

Thereby even if some alignment deviation exists between the main output shaft 161 and the developing unit 112 when attaching the process cartridge 151 in the body 102 of the image forming apparatus 101, the chamfered portion 170 can correct such alignment deviation, thereby the process cartridge 151 can be attached in the image forming apparatus 101 smoothly.

Furthermore, in the process cartridge 151, the distance between the developing sleeve shaft 155 and the shaft 152 of the photoconductive member 110*a* can be fixed to a predetermined distance, whereby image concentration unevenness can be reduced.

Furthermore, the second supporting portion 167 includes the main output shaft 161 and the bearing 169, thereby the main output shaft 161 does not contact with the sub-reference hole 168 (absorbing hole 168).

If the bearing 169 is not provided, the main output shaft 161 contacts with the sub-reference hole 168 (absorbing hole 168) directly. In such a case, the main output shaft 161 slides with the sub-reference hole 168 (absorbing hole 16$), and such sliding may cause a friction which may degrade the rotation efficiency.

However, in another example embodiment shown in FIG. 21, the second supporting portion 167 includes the main output shaft 161 and the bearing 169, whereby deterioration of the rotation efficiency can be prevented.

In another example embodiment shown in FIG. 16 to 22, the process cartridge 151 includes the photoconductive member unit 110 and the developing unit 112 as a driven unit. However, other configuration can be applied.

For example, the process cartridge 151 can include the photoconductive member unit 110 and the cleaning unit 113 as a driven unit.

In this case, the cleaning unit 113 is provided with a second supported portion, and a supporting portion is provided in the boy 102 of the image forming apparatus 101 to engage with the second supported portion.

For example, such supporting portion can be provided in the boy 102 of the image forming apparatus 101 such as at a drive shaft (not shown) used for driving the fur brush 122.

Furthermore, the process cartridge 151 having the photoconductive-member unit 110 can include both the developing unit 112 and the cleaning unit 113 as driven units.

In this case, a second supported portion is provided to each of the developing unit 112 and the cleaning unit 113.

In the above-mentioned embodiment, the image forming apparatus 101 employs an indirect transfer method, which uses the intermediate transfer belt 131 as intermediate transfer member. However, the image forming apparatus 101 can employ other configurations.

Figure 23:
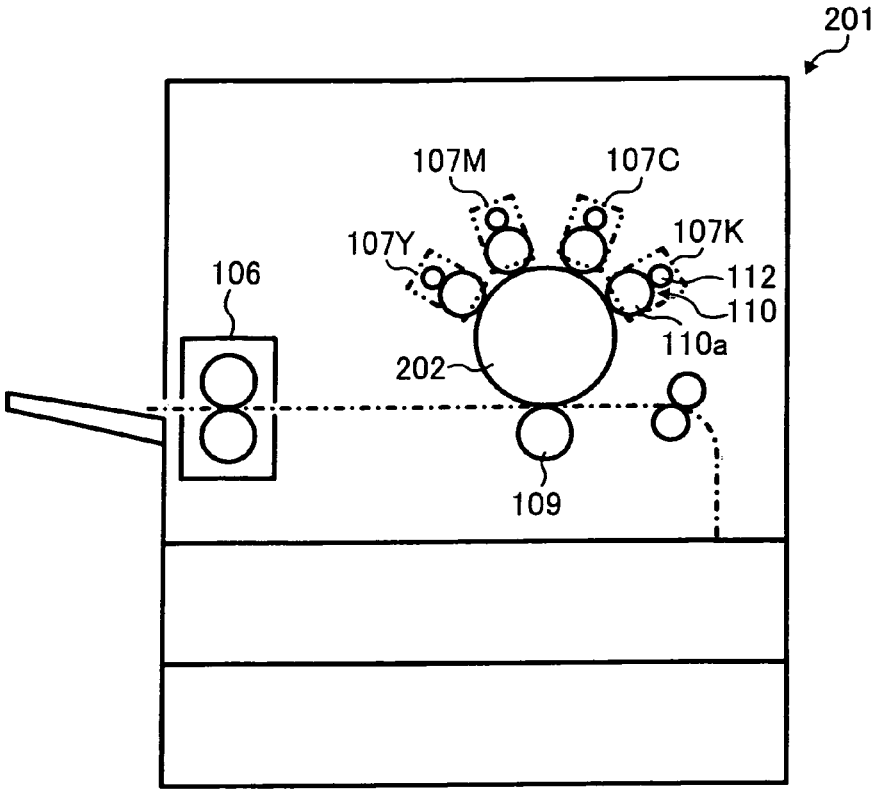
FIG. 23 is a schematic view illustrating a configuration of another image forming apparatus according to an example embodiment having an intermediate transfer drum as an intermediate transfer member.

For example, as shown in FIG. 23, an image forming apparatus 201 can employ an indirect transfer method, which uses intermediate transfer drum 202 as intermediate transfer member to conduct a full color printing.

Figure 24:
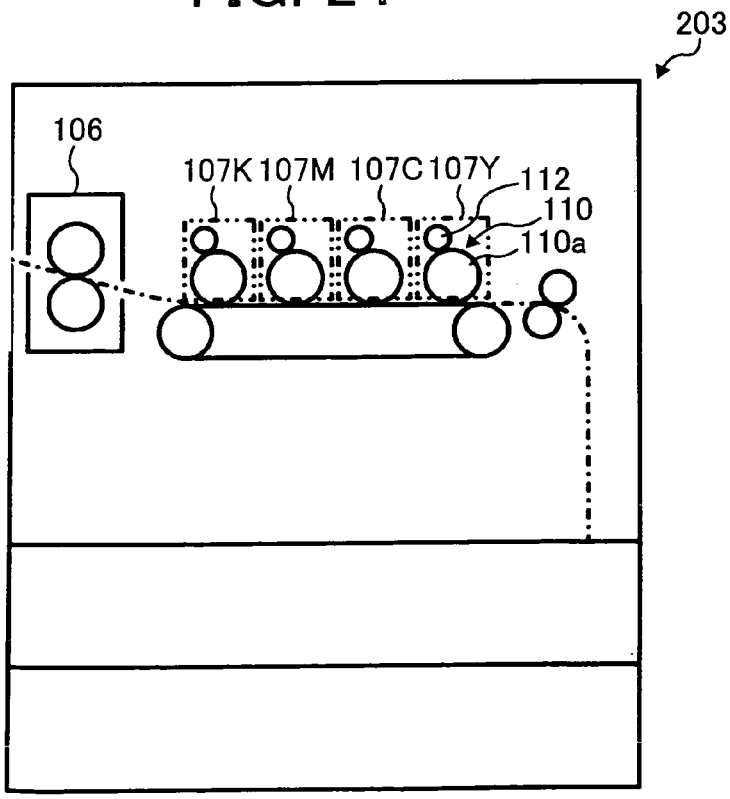
FIG. 24 is a schematic view illustrating a configuration of another image forming apparatus according to an example embodiment which directly transfers toner images to a transfer sheet.

In another example, as shown in FIG. 24, an image forming apparatus 203 can employ a direct transfer method to conduct a full color printing.

Figure 25:
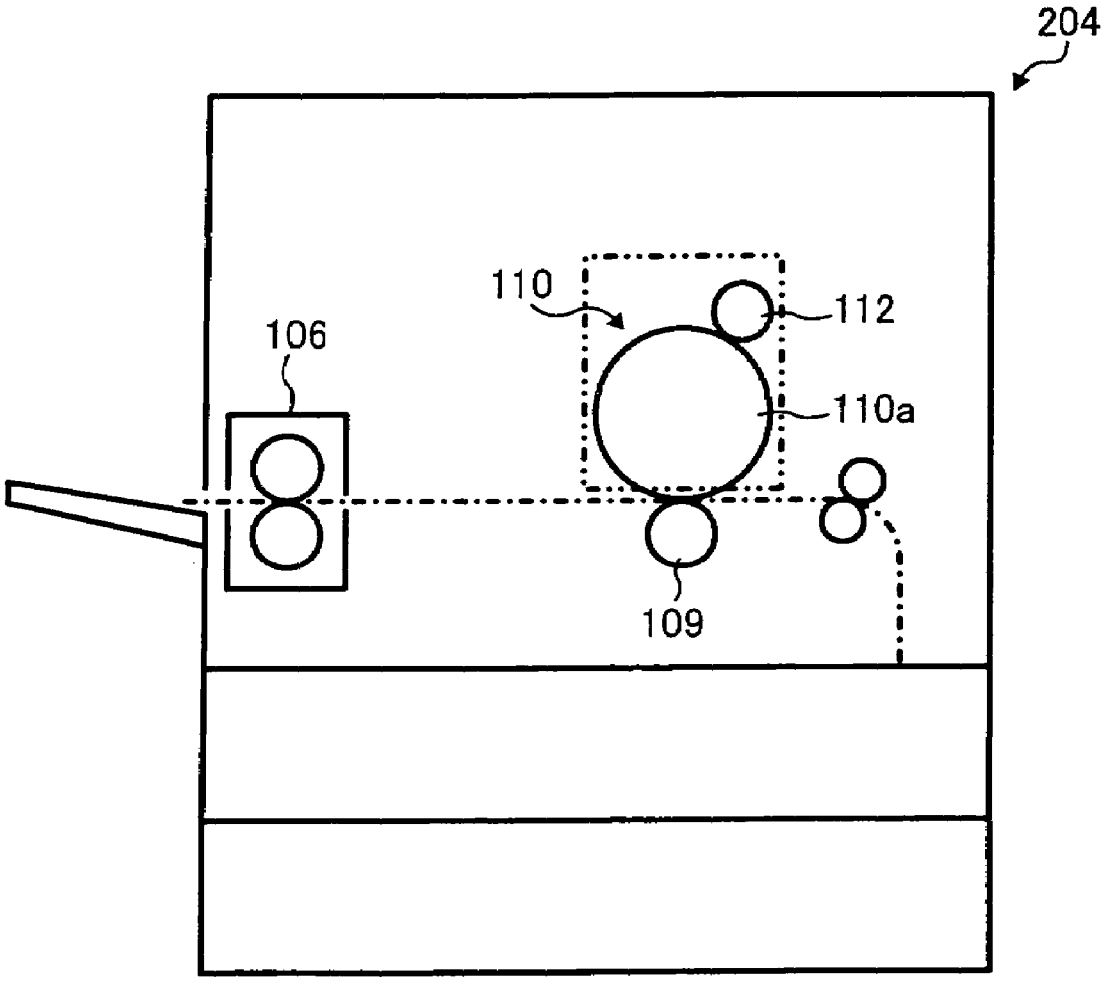
FIG. 25 is schematic view illustrating a configuration of another image forming apparatus according to an example embodiment which has one image forming unit.

In another example, as shown in FIG. 25, an image forming apparatus 204 can employ a direct transfer method to conduct a monochrome printing.

The above specific embodiments are illustrative, and many variations can be introduced on these embodiments without departing from the spirit of the disclosure or from the scope of the appended claims. For example, elements and/or features of different illustrative embodiments may be combined with each other and/or substituted for each other within the scope of this disclosure and appended claims.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications. No. 2004-260325 filed on Sep. 7, 2004, No. 2004-263099 filed on Sep. 9, 2004, and No. 2004-268548 filed on Sep. 15, 2004 in the Japan Patent Office, the entire contents of which are hereby incorporated by reference herein.

The invention claimed is:

1. A process cartridge detachably provided in an image forming apparatus having a main gear, the process cartridge, comprising:

a photoconductive unit comprising an image carrying member;

a rotatable unit, comprising;

an unit body;

an idler shaft provided on the unit body; an idler gear attached to the idler shaft and configured to be rotatable around the idler shaft;

a rotating gear coupled to the main gear via the idler gear; and a rotating member having a shaft, the rotating gear being mounted on the shaft of the rotating member, the rotating member rotating around the shaft of the rotating member and facing the image carrying member, the rotating member being driven by a driving force transmitted from the main gear via the idler gear and the rotating gear; and a positioning member configured to position the image carrying member and the rotating member with a predetermined distance therebetween, and including an absorbing hole having a slot-like slope configured to reduce an effect of an external force, generated by a rotation of the main gear, applied from the main gear to the idler gear.

2. The process cartridge according to claim 1, wherein the idler shaft is fixed to the unit body, and the idler gear is disposed at a predetermined position in a shaft line direction of the idler shaft by the positioning member.

3. The process cartridge according to claim 1, wherein the absorbing hole has a pressure angle with respect to a common tangent defined by the idler gear and the main gear.

4. The process cartridge according to claim 3, wherein the predetermined angle is substantially perpendicular to the direction of the external force.

5. The process cartridge according to claim 1, further comprising a sub-reference pin and a sub-reference hole provided to the positioning member, and wherein the sub-reference pin is inserted in the sub-reference hole and fixed with the positioning member to prevent rotation of the unit body around the shaft of the rotating member.

6. The process cartridge according to claim 5, wherein the positioning member is provided at each end of the unit body and is fixed with the sub-reference pin, and the sub-reference pin extends in a direction substantially parallel to the shaft line of the rotating member.

7. The process cartridge according to claim 1, wherein the rotatable unit includes a developing unit and the rotating member includes a developing roller, and the developing unit is configured to develop an electrostatic latent image formed on the image carrying member using a developing agent carried and transported by the developing roller.

8. The process cartridge according to claim 1, wherein the rotatable unit includes a cleaning unit and the rotating member includes a cleaning brush, and the cleaning unit is configured to remove toners remaining on the image carrying member with an effect of the cleaning brush after transferring a toner image from the image carrying member to a transfer member.

9. A process cartridge detachably provided in an image forming apparatus having a main gear, the process cartridge, comprising:

a photoconductive unit comprising means for carrying an image;

a rotatable unit, comprising;

an unit body;

an idler shaft provided on the unit body;

an idler gear attached to the idler shaft and configured to be rotatable around the idler shaft;

a rotating gear coupled to the main gear via the idler gear; and rotating means having a shaft and the rotating gear on the shaft of the means for rotating, wherein the rotating means rotates around the shaft of the rotating means and faces the means for carrying an image, and the means for rotating is driven by a driving force transmitted from the main gear via the idler gear and the rotating gear; and means for positioning the means for carrying an image and the rotating means with a predetermined distance therebetween, and including slot-shaped means for absorbing an effect of an external force, generated by a rotation of the main gear, is applied from the main gear to the idler gear.

10. An image forming apparatus, comprising:

a main gear;

a process cartridge configured to be detachable from the image forming apparatus, the process cartridge comprising:

a photoconductive unit comprising an image carrying member;

a rotatable unit, comprising;

an unit body;

an idler shaft provided on the unit body;

an idler gear attached to the idler shaft and configured to be rotatable around the idler shaft;

a rotating gear coupled to the main gear via the idler gear; and a rotating member having a shaft, the rotating gear on the shaft of the rotating member, the rotating member rotating around the shaft of the rotating member and facing the image carrying member, the rotating member being driven by a driving force transmitted from the main gear via the idler gear and the rotating gear; and a positioning member configured to position the image carrying member and the rotating member with a predetermined distance therebetween, and including a slot-shaped absorbing hole configured to reduce an effect of an external force, generated by a rotation of the main gear, is applied from the main gear to the idler gear.

11. An image forming apparatus comprising:

a main gear;

a process cartridge configured to be detachable from the image forming apparatus, the process cartridge comprising:

a photoconductive unit comprising an image carrying member;

a rotatable unit, comprising;

an unit body having a reference hole;

an idler shaft provided on the unit body;

an idler gear attached to the idler shaft and configured to be rotatable around the idler shaft;

a rotating gear coupled to the main gear via the idler gear; and a rotating member having a shaft the rotating gear being mounted on the shaft of the rotating member, the rotating member rotating around the shaft of the rotating member and facing the image carrying member, the rotating member being driven by a driving force transmitted from the main gear via the idler gear and the rotating gear:

a main output shaft provided with the main gear provided thereon, and including a first portion rotatably supported by a body of the image forming apparatus, and a second portion rotatably supported by a slot-shaped reference hole formed in the unit body of the rotatable unit when the process cartridge is attached into the image forming apparatus; and a driving motor configured to drive the main gear via the main output shaft.

12. The image forming apparatus according to claim 11, wherein the main gear is movable in a shaft line direction of the main output shaft, and is biased in a direction to the process cartridge.

13. The image forming apparatus according to claim 12, wherein the main output shaft is provided with a spring thereon to bias the main gear in the direction to the process cartridge.

14. The image forming apparatus according to claim 11, further comprising a pulley fixed to the main output shaft and a belt extended by the pulley, and wherein the driving motor drives the main output shaft by using the pulley and the belt.

15. The image forming apparatus according to claim 11, wherein the reference hole includes a chamfered portion configured to guide the second portion of the main output shaft into the reference hole when attaching the process cartridge into the image forming apparatus.

16. The image forming apparatus according to claim 15, wherein the second portion of the main output shaft is provided with a bearing to engage with the reference hole.

17. The image forming apparatus according to claim 11, wherein the rotatable unit includes a developing unit and the rotating member includes a developing roller, and the developing unit is configured to develop an electrostatic latent image formed on the image carrying member using a developing agent carried and transported by the developing roller.

18. The image forming apparatus according to claim 11, wherein the rotatable unit includes a cleaning unit and the rotating member includes a cleaning brush, and the cleaning unit is configured to remove toners remaining on the image carrying member with an effect of the cleaning brush after transferring a toner image from the image carrying member to a transfer member.

19. An image forming apparatus, comprising: a first supporting portion;

a second supporting portion;

a main gear;

a main output shaft provided with the main gear thereon;

a process cartridge, comprising:

a photoconductive unit comprising an image carrying member having a shaft, and a first supported portion on an end portion of the shaft, which is supported by the first supporting portion when the process cartridge is attached in the image forming apparatus;

a rotatable unit, comprising;

an unit body having a second supported portion, which is supported by the second supporting portion when the process cartridge is attached in the image forming apparatus, the unit body is positioned in a predetermined position in the image forming apparatus when the process cartridge is attached in the image forming apparatus with the first and second supporting portions and the corresponding first and second supported portions;

an idler shaft provided on the unit body;

an idler gear attached to the idler shaft and configured to be rotatable around the idler shaft;

a rotating gear coupled to the main gear via the idler gear;

rotating member having a shaft, the rotating gear being mounted on the shaft of the rotating member, the rotating member rotating around the shaft of the rotating member and facing the image carrying member, the rotating member driven by a driving force transmitted from the main gear via the idler gear and the rotating gear; and a positioning member configured to position the image carrying member and the rotating member with a predetermined distance therebetween, and including an absorbing hole having a slot-like slope configured to reduce an effect of an external force, generated by a rotation of the main gear, applied from the main gear to the idler gear.

20. The image forming apparatus according to claim 19, wherein the first supporting portion includes a bearing, which rotatably supports the first supported portion.

21. The image forming apparatus according to claim 19, wherein the second supported portion includes an absorbing hole configured to reduce an effect of an external force, generated by rotation of the main gear, applied from the main gear to the idler gear.

22. The image forming apparatus according to claim 21, wherein the absorbing hole has a slot-like shape having a longer side which has a predetermined angle with respect to a direction of the external force, which has a pressure angle with respect to a common tangent defined by the idler gear and the main gear.

23. The image forming apparatus according to claim 22, wherein the predetermined angle is substantially perpendicular to the direction of the external force.

24. The image forming apparatus according to claim 19, wherein the second supporting portion is formed on one end portion of the main output shaft by attaching a bearing on the one end portion of the main output shaft, and the bearing is configured to engage with the second supported portion.

25. The image forming apparatus according to claim 21, wherein the absorbing hole includes a chamfered portion configured to guide the second supporting portion into the absorbing hole when attaching the process cartridge into the image forming apparatus.

26. The image forming apparatus according to claim 19, wherein the rotatable unit includes a developing unit and the rotating member includes a developing roller, and the developing unit is configured to develop an electrostatic latent image formed on the image carrying member using a developing agent carried and transported by the developing roller.

27. The image forming apparatus according to claim 19, wherein the rotatable unit includes a cleaning unit and the rotating member includes a cleaning brush, and the cleaning unit is configured to remove toners remaining on the image carrying member with an effect of the cleaning brush after transferring a toner image from the image carrying member to a transfer member.

* * * * *